US005717443A

United States Patent [19]

Numata et al.

[11] Patent Number: 5,717,443

[45] Date of Patent: Feb. 10, 1998

[54] INK JET RECORDING APPARATUS INCLUDING AN INK RECOVERY SYSTEM OPERATED IN CORRELATION WITH THE INK SHEET FEEDING SYSTEM

[75] Inventors: Yasuhiro Numata; Haruo Uchida, both of Yokohama; Souhei Tanaka, Kawasaki; Noribumi Koitabashi, Yokohama; Hiroaki Kitazawa, Yokohama; Hiromitsu Hirabayashi, Yokohama; Hiroshi Tajika, Yokohama; Hitoshi Sugimoto, Yokohama, all of Japan

[73] Assignee: Canon Kabushiki Kaisha, Tokyo, Japan

[21] Appl. No.: 766,889

[22] Filed: Dec. 13, 1996

Related U.S. Application Data

[63] Continuation of Ser. No. 388,895, Feb. 14, 1995, abandoned, which is a continuation of Ser. No. 297,902, Aug. 31, 1994, abandoned, which is a continuation of Ser. No. 822,328, Jan. 17, 1992, abandoned.

[30] Foreign Application Priority Data

| | | | |
|---|---|---|---|
| Jan. 8, 1991 | [JP] | Japan | 3-004393 |
| Jan. 18, 1991 | [JP] | Japan | 3-004387 |
| Jan. 17, 1992 | [JP] | Japan | 3-006494 |

[51] Int. Cl.[6] ..... B41J 2/165

[52] U.S. Cl. ..... 347/16; 347/23; 347/30; 347/104

[58] Field of Search ..... 347/5, 16, 23, 347/30, 32, 37, 39, 104

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,359,744 | 11/1982 | Salmre | 347/30 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,577,203 | 3/1986 | Kawamura | 346/140 R |
| 4,723,129 | 2/1988 | Endo et al. | 347/56 |
| 4,740,796 | 4/1988 | Endo et al. | 347/56 |
| 4,752,786 | 6/1988 | Inoue et al. . | |
| 4,872,026 | 10/1989 | Rasmussen et al. | 347/104 |
| 4,884,909 | 12/1989 | Watanabe et al. | 400/625 |
| 5,019,839 | 5/1991 | Watanabe et al. | 346/140 R X |
| 5,126,764 | 6/1992 | Miyaauchi et al. | 346/140 R |
| 5,182,583 | 1/1993 | Horigome et al. | 346/140 R |

FOREIGN PATENT DOCUMENTS

| | | | |
|---|---|---|---|
| 56-56847 | 5/1979 | Japan . | |
| 59-014966 | 1/1984 | Japan . | |
| 59-52660 | 3/1984 | Japan | 347/23 |
| 59-123670 | 7/1984 | Japan . | |
| 59-138461 | 8/1984 | Japan . | |
| 59-209259 | 11/1984 | Japan | 347/23 |
| 60-71260 | 4/1985 | Japan . | |
| 62-25054 | 2/1987 | Japan . | |
| 62-95224 | 5/1987 | Japan . | |
| 62-122572 | 5/1988 | Japan . | |
| 1082962 | 3/1989 | Japan . | |

OTHER PUBLICATIONS

Jackson et al; *DeskJet Printer Chassis and Mechanism Design;* Hewlett–Packard Journal; Oct., 1988; pp. 67–75.

*Primary Examiner*—John E. Barlow, Jr.
*Attorney, Agent, or Firm*—Fitzpatrick, Cella, Harper & Scinto

[57] ABSTRACT

This invention relates to an ink jet recording apparatus with a support member for supporting an ink jet recording head for effecting recording by ink discharge onto a recording material, comprising: recording material transport means for transporting the recording material from a feeding position through a recording position to a discharge position; and recovery means for maintaining and restoring the ink discharge state of said ink jet recording head. The driving source for driving the recording material transport means or support member is also used for driving the recovery means, and, when the power supply to the apparatus is turned on, the initial operations of at least the recording material transport means and the recovery means are conducted utilizing a single sensor.

14 Claims, 25 Drawing Sheets

INK JET RECORDING APPARATUS INCLUDING AN INK RECOVERY SYSTEM OPERATED IN CORRELATION WITH THE INK SHEET FEEDING SYSTEM

This application is a continuation of application Ser. No. 08/388,895 filed Feb. 14, 1995, which was a continuation of application Ser. No. 08/297,902 filed Aug. 31, 1994, which was a continuation of application Ser. No. 07/822,328 filed Jan. 17, 1992, all now abandoned.

BACKGROUND OF THE INVENTION

1. Field of the Invention

The present invention relates to an ink jet recording apparatus, for forming a desired image by discharging ink from discharge openings.

2. Related Background Art

An ink jet recording apparatus, for forming a desired image by discharging ink from a discharge opening and depositing the ink on a recording member, is composed, for example, of a recording member transport system for moving the recording member from a feeding section through a recording section to a discharge section, a carriage system for supporting an ink jet recording head for ink discharge and moving the recording head relative to the recording member, and a recovery system for maintaining and restoring the ink discharge state of the recording head. These transport system, carriage system and recovery system are equipped with independent driving sources and independent position sensors, and a high-quality recording is attained by the precise transportation of the recording member, precise movement of carriage and desired recovery operations by these systems. Also, at the start of power supply to the recording apparatus, these systems effect initialization (initial positining) in an independent manner.

However, in a compact and inexpensive version of the apparatus, such independent control of these systems is undesirable, because such a configuration requires a larger number of component parts and sensors, thus leading to a higher cost and requiring a larger space for installation.

SUMMARY OF THE INVENTION

In consideration of the foregoing, the object of the present invention is to provide an ink jet recording apparatus which is inexpensive and compact, is highly reliable and is capable of high-quality image recording.

Through investigations for attaining the above-mentioned the, inventors of the present invention have found that the common use of a drive source for all or a part of the driving systems, such as the transport system, carriage system and recovery system, allows a reduction in the number of component parts, thereby reducing the cost and the space needed for installation. It has also been found that such common use of drive source enables correlation of the functions of the driving systems, thereby allowing a reduction in the number of sensors needed for sensing the functions of those systems.

The present invention, reached through the above-mentioned finding, is featured by an ink jet recording apparatus with a support member for supporting an ink jet recording head for forming a recording by ink discharge onto a recording material, comprising recording material transport means for transporting a recording material from a feed position through a recording position to a discharge position, and recovery means for maintaining and restoring the ink discharge state of the jet recording head, wherein a driving source for the transport means or the head support member is used in common as the driving source for the recovery means, and, at the start of power supply to the apparatus, the initialization of at least the transport means and the recovery means is conducted with a single sensor.

The present invention also features an ink jet recording apparatus having a support member for supporting an ink jet recording head for forming a recording by ink discharge onto a recording material, comprising recovery means for maintaining and restoring the ink discharge state of the ink jet recording head, recording material transport means for transporting the recording material from a feed position through a recording position to a discharge position, common drive means for driving the recovery means and the transport means, memory means for memorizing the state of the recovery means and transport means immediately before the power supply to the apparatus is turned off, and control means for initializing the recovery means according to the state memorized in the memory means.

The present invention also features an ink jet recording apparatus for forming a recording by ink discharge from an ink jet recording head onto a recording material, comprising recovery means for maintaining and restoring the ink discharge state of the ink jet recording head, carriage means for supporting the ink jet recording head and enabling a desired recording by relative motion to the recording material, common drive means for driving the recovery means and carriage means, memory means for memorizing the state of the recovery means and the carriage means or transport means for transporting the recording material from a feed position to a discharge position, immediately before the termination of power supply to the apparatus, and control means for initializing the recovery means according to the state memorized in the memory means.

The use of a common driving source for different driving systems correlates the functions of the driving systems, whereby the number of sensors needed for detecting the initial position, drive end position, stop position etc. can be reduced. Also because of the correlated functions of the driving systems resulting from the use of a common driving source, a same initializing operation, if conducted at the start of power supply and at the sheet jamming, may result in a trouble. Thus, an appropriate initializing operation can be conducted by memorizing the function states of the driving systems at the termination of power supply.

DETAILED DESCRIPTION OF THE PREFERRED EMBODIMENTS

Now the present invention will be clarified in detail by preferred embodiments thereof shown in the attached drawings.

[1st embodiment]

Figure 2:
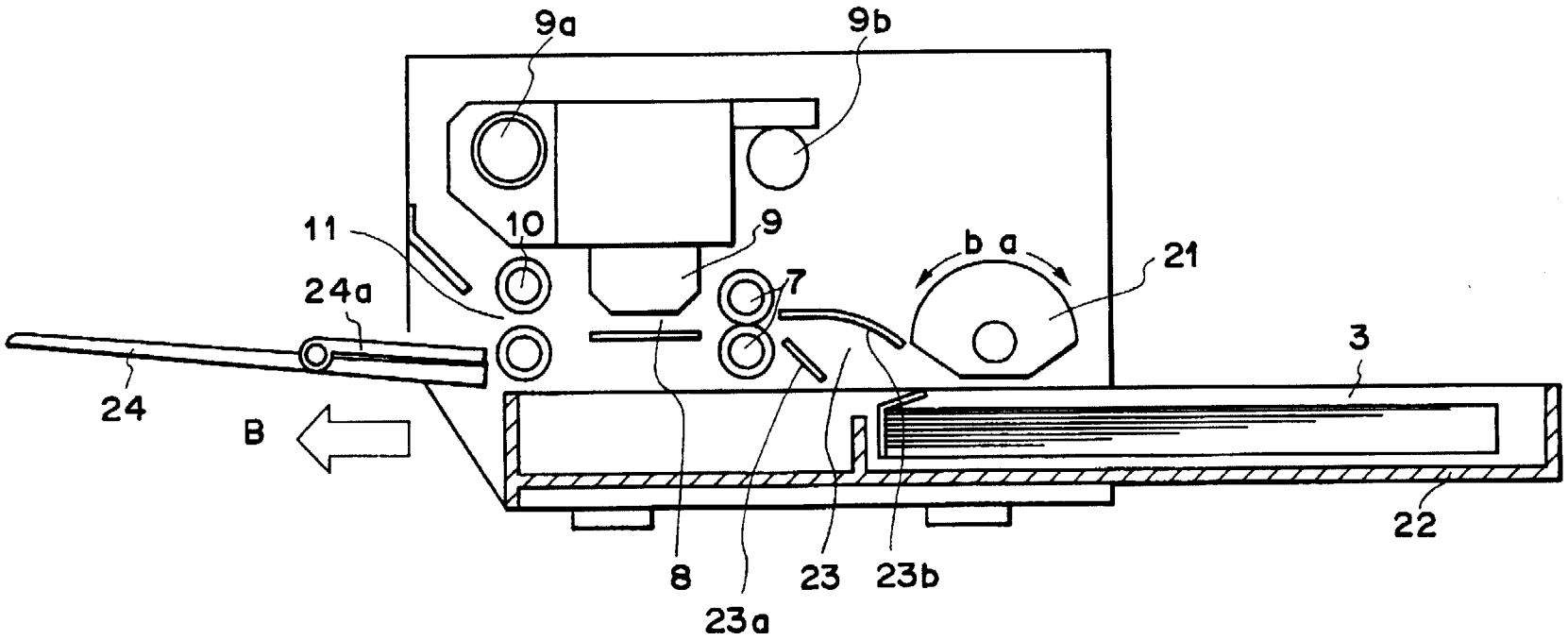
FIG. 2 is lateral view of an embodiment of the apparatus of the present invention, showing the initial state of a pick-up roller.

The configuration of the present invention will be explained in the order of the sheet feeding system and recovery system. FIG. 2 illustrates a recording apparatus, with the front side at the left, in a state of sheet feeding from a cassette 22. A guide portion 23 is composed of sheet guide members 23*a*, 23*b* and guides a sheet 3, fed by a pickup roller 21 from the cassette 22, to a sub scanning roller 7. In a recording unit 8, recording is performed on the sheet by ink droplet discharge from a recording head 9, which is rendered movable in the transverse direction of the sheet, along guide rails 9*a*, 9*b*.

Figure 3:
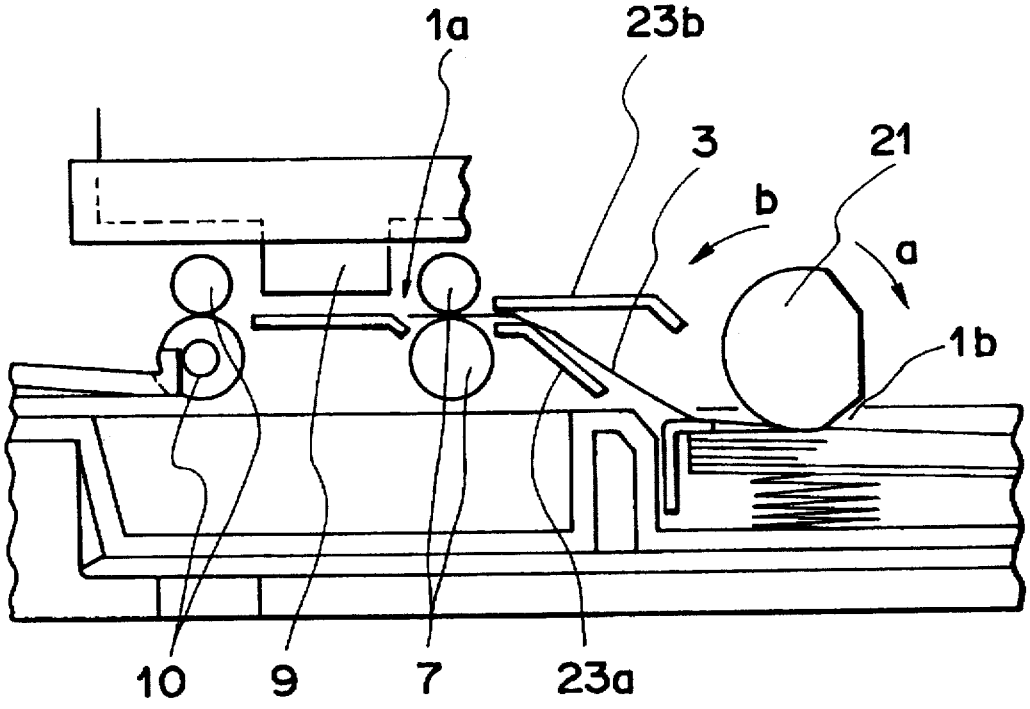
FIG. 3 is a magnified view of the pick-up roller shown in FIG. 2.
Figure 4:
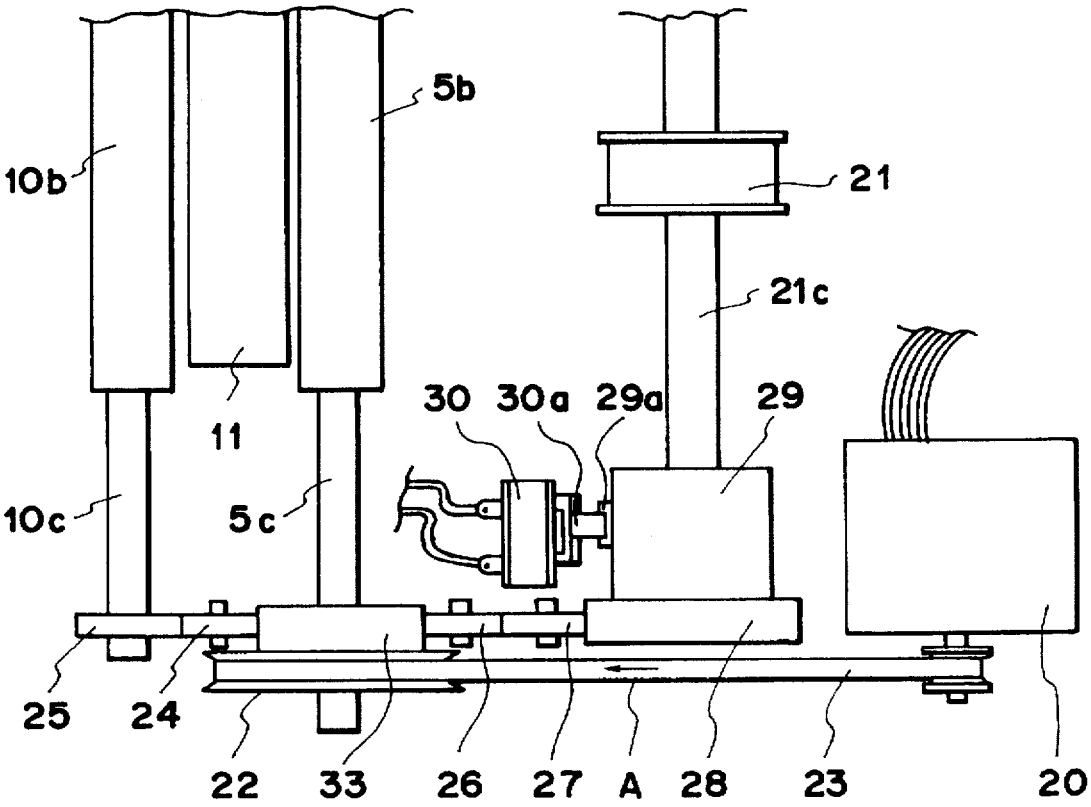
FIG. 4 is a schematic view of a part of the transport means for the recording material in the apparatus of the present invention.

Now reference is made to FIGS. 3 and 4 for explaining the function of the pickup roller 21, the initial state of which is shown in FIG. 2. The pickup roller rotates in a direction a or b, by reverse or forward rotation of a sub scanning motor 20.

The driving force of the sub scanning motor 20 is transmitted, through a gear 33 and idler gears 26, 27, to a gear 28. Between the gear 28 and the shaft of the pickup roller 21 there is provided a spring clutch 29, which selectively transmits the driving force transmitted to the gear 28. A plunger 30 controls the state of the spring clutch 29. When the plunger 30 is off, a plunger rod 30*a* engages with a finger of the spring clutch 29, whereby the clutch 29 is cut off and the driving force is not transmitted to the shaft thereof. When the plunger 30 is on, the plunger rod 30*a* moves to the left and is disconnected from the finger 29*a*, whereby the driving force is transmitted to the shaft of the spring clutch.

In the sheet feeding operation of the apparatus, the plunger is turned on once, in order to rotate the pickup roller by one turn, whereupon the pickup roller 21 rotates in the direction a as shown in FIG. 3, thus advancing the sheet 3 from the cassette 22. As explained above, the pickup roller rotates in the direction a or b, respectively by reverse or forward rotation of the sub scanning motor. After sheet advancement, the pickup roller assumes the following state by the forward or reverse rotation of the sub scanning motor.

If the sub scanning motor rotates in the forward direction, the pickup roller is driven in the direction b, and, if the cassette 22 is loaded in the apparatus, stops in contact with the upper surface of the sheets 3 therein. This state is maintained unless the motor rotates in the reverse direction. If the cassette is not loaded, the pickup roller rotates in the direction b by the forward rotation of the motor. If the sub scanning motor rotates in the reverse direction, the pickup roller is driven in the direction a, and, since the above-explained plunger is normally off, stops in a state shown in FIG. 2.

Figure 5:
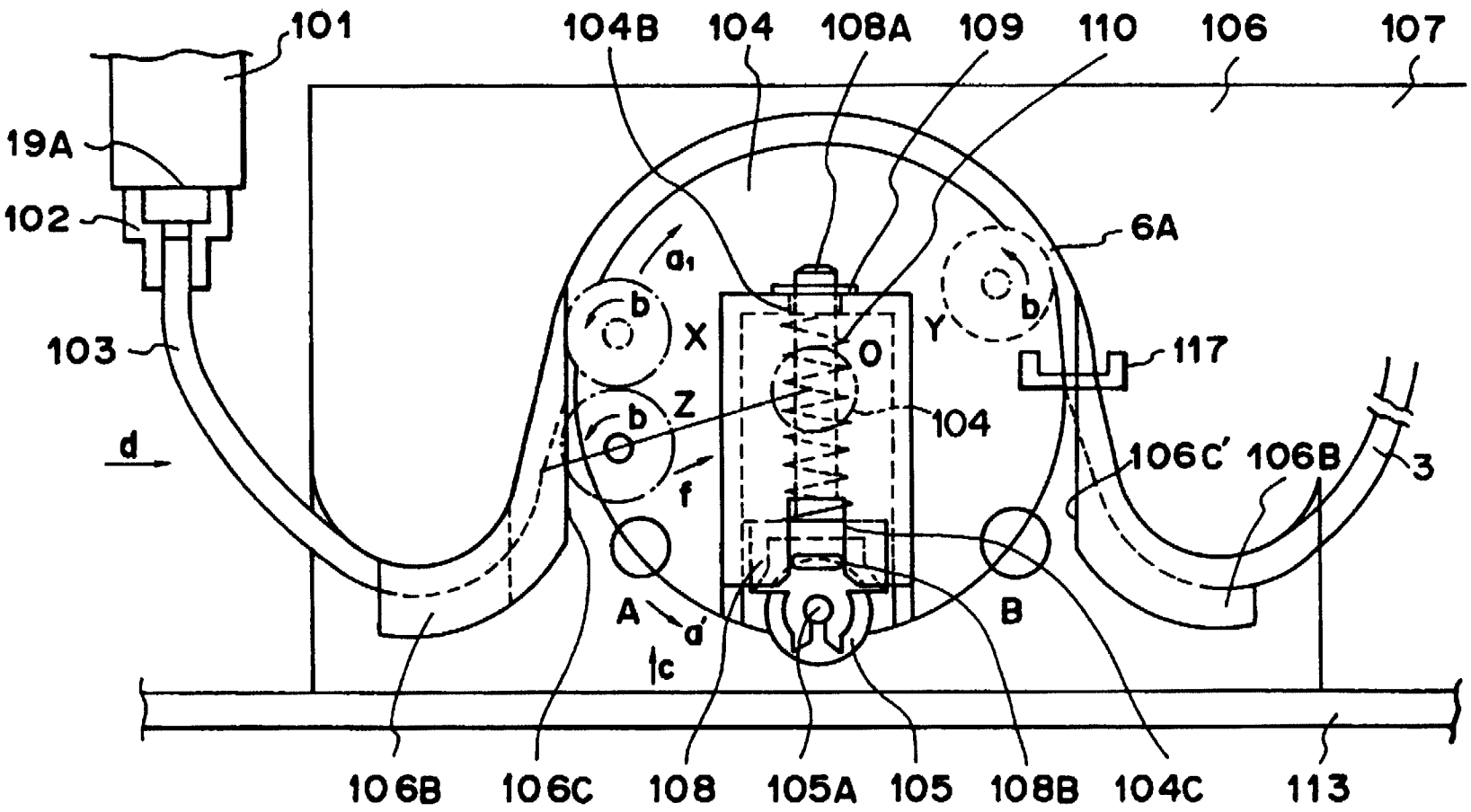
FIG. 5 is a schematic view of a tube pump.

Next, there will be given an explanation of the recovery system. FIG. 5 is a cross-sectional view of a tube pump.

When a discharge opening (not shown) of an ink jet recording head 101 is clogged, a recovery operation by suction is executed in a non-recording position of the recording head.

In the said recovery operation by suction, an aperture of a cap 102 is brought into contact with the ink jet recording head 101 in the non-recording position thereof, thereby forming a sealed space at the discharge openings. The other aperture of the cap 102 is connected to a tube 103, which constitutes a tube pump together with a guide roller 104, a pressure roller 105 and a pump base 106. At the other end of the tube 103 there is provided a discharged ink disposing member 107, which receives the ink extracted from the discharge openings by suction.

As the guide roller 104 is rotated in a rotated, the pressure roller 105 presses the tube 103 at a position X until the internal space of the tube becomes zero. As the guide roller 104 is rotated further from the position X in the direction $a_1$, the pressure roller 105 follows the movement, while rotating in a direction b and maintaining the tube 103 in pressed state, and stops temporarily at a position Y. Because of the change in the internal volume of the tube, by pressing with the pressure roller between the positions X and Y, there is generated a negative pressure, thereby effecting suction. The tube pump has a home position at B, which is also the initial position of said pump, where the pressure roller does not press the tube.

In the present embodiment, the guide roller 104 is driven by the sub scanning motor, which is the same driving source as that for the pickup roller, sub scanning roller and sheet discharge rollers 10. Therefore, in the present embodiment, forward rotation of the sub scanning motor causes reverse rotation of the pickup roller and forward rotation of the guide roller at the same time. While the pickup roller makes a full turn, the guide roller rotates by 90°.

In the following, there will be explained the initial operations of the sheet feeding system and the recovery system.

Figure 1:
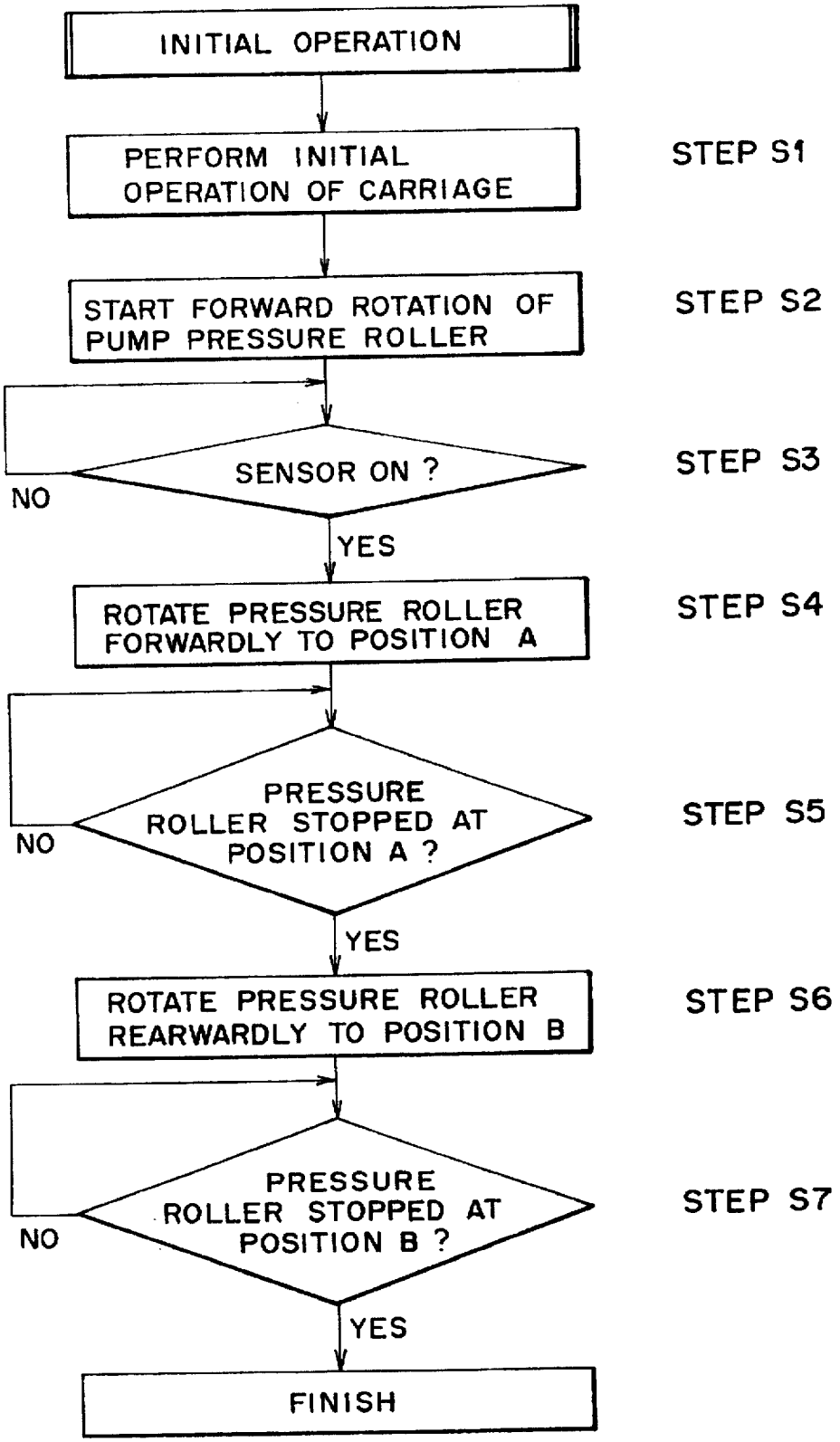
FIG. 1 is flow chart of the control sequence of the present invention.

FIG. 1, which is a flow chart of the initial operations of the ink jet recording apparatus at the start of power supply, best represents the features of the present invention.

A step S1 effects initialization of the carriage, which need not be explained as it is not directly related to the present invention. Then a sequence starting from step S2 effects initialization of the pressure roller of the pump, constituting a feature of the present invention. The step S2 causes the sub scanning motor to make a full idle turn in the forward direction, in order to detect the position of the pressure roller by a sensor 117.

Sensor 117 is composed of a photointerrupter, including a sensor flag (not shown) provided in a part of the guide roller and rotating integrally therewith. After the start of idle rotation, a step S3 waits until the sensor is turned on. When the turning-on of the sensor is detected, a step S4 brings the pressure roller to a position A, where the pressure roller does not press the tube as in the position A. A step S5 checks the completion of movement of the pressure roller to the position A. Then a step S6 effects reverse rotation of the sub scanning motor in order to bring the pressure roller to the position B, and a step S7 checks the completion of movement at the position B. The initial operations are completed when the pressure roller is moved to the position B.

The meaning of the positions A and B will be explained as follows. If the initial operations of the pick-up roller are not considered, the initial position of the pressure roller need not be limited to the position A or B, but can be anywhere not pressing the tube.

The pick-up roller is rotated to an initial position shown in FIG. 2, in the reverse rotation of the sub scanning motor in the step S6. In this operation, the rotation of the sub scanning motor is enough to cause the pick-up roller to rotate by a full turn, so that it can reach the initial position regardless of its start position. Since the plunger is turned off, the pick-up roller rotates to the initial position where the finger of the spring clutch engages with the plunger rod. After the arrival of the pick-up roller at the initial position, the shaft slips owing to the spring clutch, though the sub scanning motor continues to rotate. When the sub scanning motor stops, the guide roller has been rotated by 90° in a direction a'. Therefore, in order to stop the pickup roller at the initial position when the guide roller is stopped at the position B, the guide roller is at first stopped at the position A where the lines A–O and B–O forms an angle of 90° in which O indicates the shaft of the guide roller.

Figure 6:
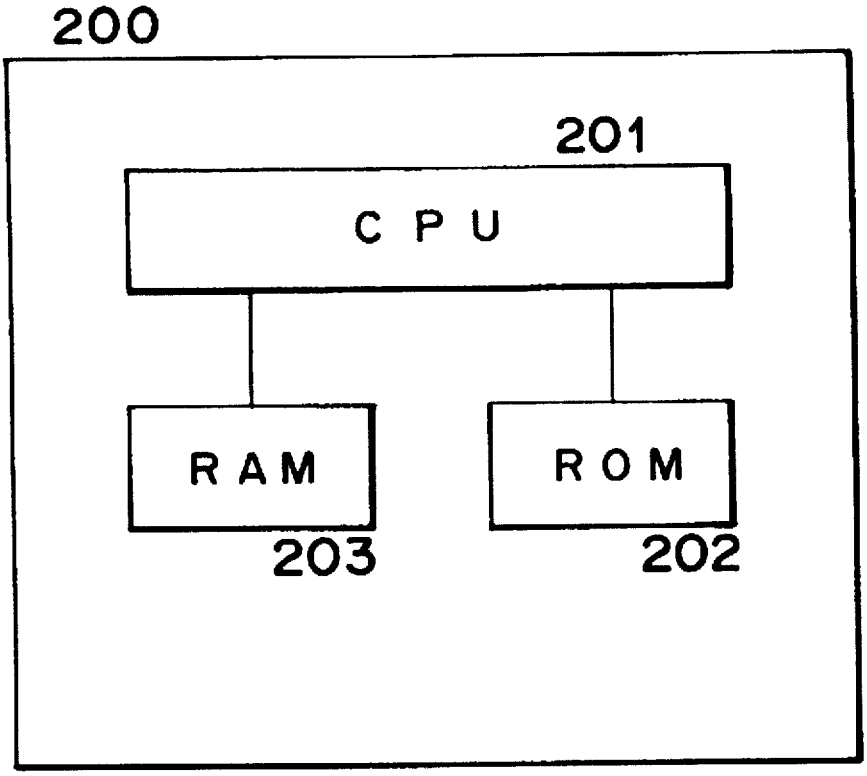
FIG. 6 is a schematic block diagram of a control unit applicable to the apparatus of the present invention.

Configuration of the control system of the above-explained apparatus is shown in FIG. 6, wherein a control unit 200 includes a CPU 201 for executing the sequence shown in FIG. 1, a ROM 202 which stores fixed data including a program corresponding to the sequence, and a RAM 203 used as a work area.

[2nd embodiment]

In the foregoing embodiment, there has been explained the control procedure in those cases where the tube pump and the sheet feeding means are driven by a common driving source. It is also possible, when the tube pump and cleaning means for the ink jet recording head are driven by a common driving source, to effect the initial operations of the tube pump and cleaning means with a single sensor at the start of power supply.

[3rd embodiment]

Another embodiment of the present invention will be explained in the following, in the order of sheet transport system and recovery system.

FIG. 2 illustrates a recording apparatus of the present embodiment, with the front side at the left, showing a state of sheet feeding from a cassette 22 constituting first sheet feeding means. A guide portion 23 is composed of sheet guide members 23*a*, 23*b* and guides a sheet 3, fed by a feed roller 21 from the cassette 22, to a pair of sub scanning rollers 7. In a recording unit 8, recording is conducted on the sheet by an ink droplet discharge from a recording head 9, which is rendered movable in the transversal direction of the sheet, along guide rails 9*a*, 9*b*. The printed sheet is discharged, by discharge rollers 10, through a discharge slot 11 onto a sheet discharge tray 24. The cassette 22 can be extracted in a direction B for sheet loading.

Figure 7:
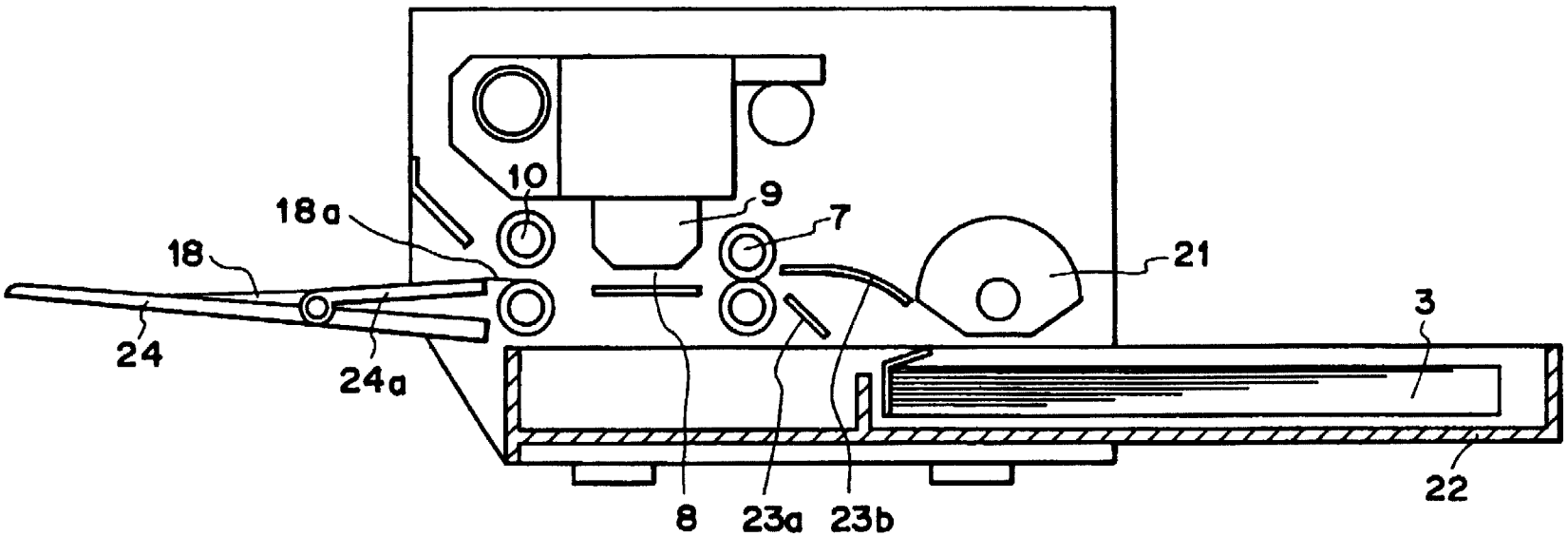
FIG. 7 is a schematic lateral view of another embodiment of the present invention, in a manual sheet feed mode.
Figure 8:
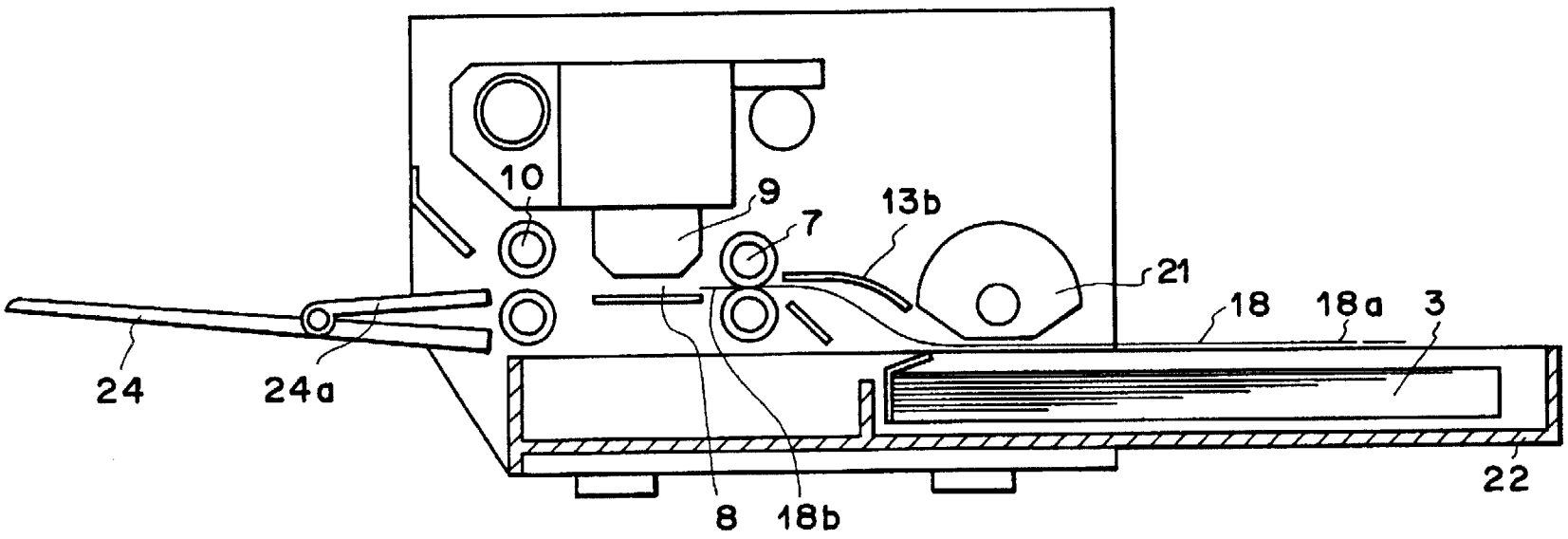
FIGS. 8 and 9 are schematic views showing the states in the manual sheet feed mode shown in FIG. 7.
Figure 9:
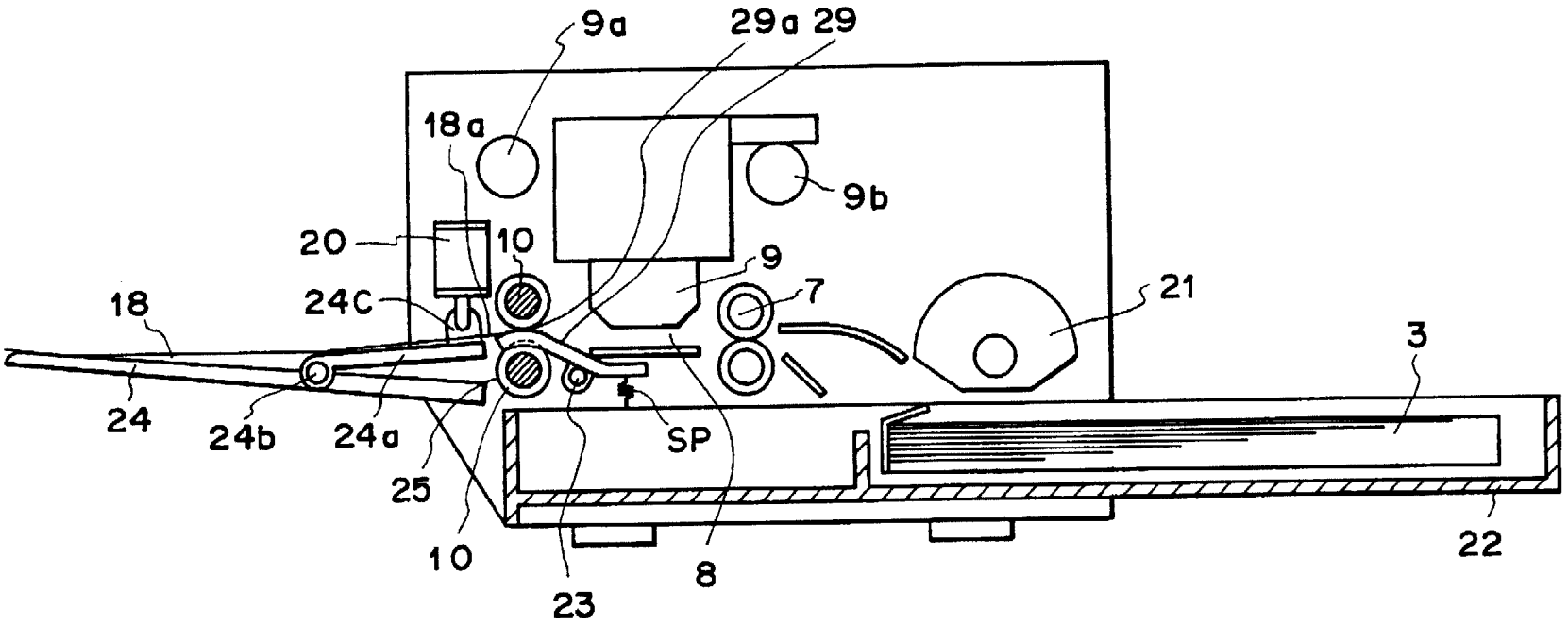

FIGS. 7 and 8 illustrate schematically a manual sheet feeding unit constituting second sheet feed means, and FIG. 9 is a detailed view thereof.

FIG. 7 shows a state in which a sheet 18 is set for manual sheet feeding (manual insertion). In response to the actuation of a manual sheet feed switch SW1, the electric system is switched from the cassette sheet feed mode to the manual sheet feed mode, and a plunger 20 is energized to lift a manual feed guide plate 24*a*. When the operator inserts the sheet along the guide plate, the leading end 18*a* of the sheet impinges on the nip of the sheet discharge rollers 10 and pushes a sheet detection lever 29, whereupon an electrical signal generated by a photosensor activates the discharge rollers 10 and the sub scanning rollers 7 in a direction opposite to the normal driving direction, thereby introducing the sheet 18 into the recording apparatus. The leading end 18*a* of the sheet is guided, by the guide member 23*b*, between the feed roller 21 and the uppermost sheet in the cassette 22.

FIG. 8 shows a state in which the inserted sheet is temporarily stopped in the recording apparatus, at such a position that the rear end 18*b* of the sheet is positioned at the right of the recording unit 8 after passing through the sheet detection lever 29 shown in FIG. 9 but is still pinched by the sub scanning roller 7. More specifically, a counting operation is started when the rear end of the sheet passes through the lever 29, and the roller is stopped at a predetermined count. In the state shown in FIG. 8, a print start signal is given to activate the sub scanning roller 7 and the discharge rollers 10 in the normal direction and to deactivate the plunger 20, whereupon the guide plate 24*a* returns to the state shown in FIG. 3 and the manually fed sheet 18 is printed and discharged in the same manner as in the sheet feeding from the cassette 22.

Referring to FIG. 9, the manual feed guide plate 24*a* is rotatably mounted on the discharge tray 24. Guide plate 24*a* is lifted to an illustrated position where the end is directed to the nip of the discharge rollers 10 when the plunger 20 is energized, and returns by its weight to the position in FIG. 2 when the plunger 20 is deactivated. The sheet detection lever 29 detects the presence of a sheet when it is pinched between the discharge rollers 10, regardless of whether the sheet has arrived from the right or from the left.

Next, there will be given an explanation of the recovery system. FIG. 5 is a cross-sectional view of a tube pump.

When a discharge opening (not shown) of an ink jet recording head 101 is clogged, a recovery operation by suction is executed in a non-recording position of the recording head.

In the recovery operation by suction, an aperture of a cap 102 is brought into contact with the ink jet recording head 101 in the non-recording position thereof, thereby forming a sealed space at the discharge openings 101A. The other aperture of the cap 102 is connected to a tube 103, which constitutes a tube pump together with a guide roller 104, a pressure roller 105 and a pump base 106. At the other end of the tube 103 there is provided a discharged ink disposing member 107, which receives the ink extracted from the discharge openings by suction.

The shaft 105A of a pressure roller 105, for pressing the tube, is rotatably mounted on a roller bearing 108, and the pressure roller 105 is biased, by a compression spring 110, in a direction for pressing the tube. The shaft 104A of a guide roller 104 is rotatably supported, with a bearing (not shown), by a pump base 106. As the guide roller 104 is rotated, the pressure roller 105 presses the tube 103 at a position X, until the internal space of the tube becomes zero. When the guide roller 104 is rotated further in a direction $a_1$, the pressure roller 105 follows the movement from the position X, while being rotated in a direction b, and is temporarily stopped at a position Y. Because of the volume change in the tube, by the pressing with the pressure roller between the positions X and Y, there is generated negative pressure to effect suction.

In the present embodiment, the guide roller 104 is driven by a driving source, which is the same as that for the sub scanning roller and the discharge rollers 10. Consequently, the guide roller rotates when the sub scanning roller is rotated in the sheet feeding or discharging operation.

The sheet feeding system and the recovery system are further correlated in the following manner. In the sheet feeding operation from the cassette, in the sheet feeding during a recording operation, and in the sheet discharging operation, the sub scanning roller and the sheet discharge rollers are rotated in the forward direction. In these operations, the aperture of the cap 102 is not in contact with the ink jet recording head 101. When the guide roller 104 is rotated clockwise in the direction $a_1$ in a state shown in FIG. 5, air enters the tube, and ink or air contained in the tube move toward the discharged ink tank.

The manual sheet feeding operation involves the reverse rotation of the sub scanning roller and the sheet discharge rollers, during which the aperture of the cap 102 is not in contact with the ink jet recording head 101. As the guide roller rotates anticlockwise in FIG. 5, the ink and air contained in the tube move from right to left, toward the cap.

In a recording operation with manual sheet feeding, the ink and air contained in the tube move toward the discharged ink tank as long as the manual sheet feeding, recording and sheet discharge are conducted in the normal manner, without error or jamming. More specifically, such ink and air move toward the cap during the manual sheet feeding, corresponding to 3500 (297/8.128×96) pulses, and then toward the discharged ink tank during the recording operation by 3500 pulses and during the sheet discharge by 4000 pulses (200/8.128×96+1080+600), so that they move in total toward the exhaust ink tank by 4000 pulses. However, if sheet jamming occurs in the course of manual sheet feeding, the guide roller is stopped during anticlockwise rotation and the recording and sheet discharge are not performed. As a result, the ink and air in the tube move toward the cap, in comparison with the state prior to the manual sheet feeding.

Figure 10:
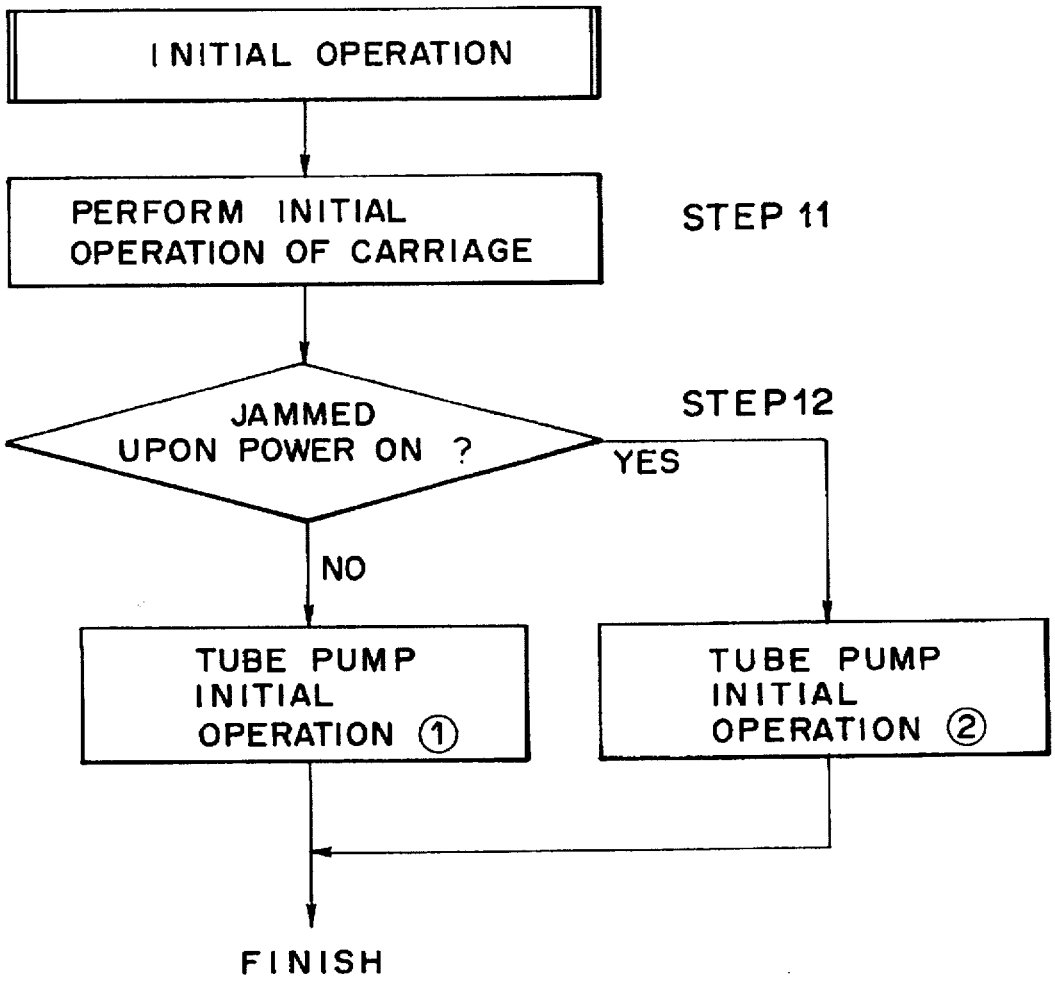
FIG. 10 is a flow chart of the control sequence of another embodiment of the present invention.

FIG. 10, which is a flow chart of the initial operation of the ink jet recording apparatus at the start of power supply, best represents the features of the present invention. At first a step S11 effects initialization of the carriage, which need not be explained as it is not directly related to the present invention. Then a sequence starting from a step S12, constituting the feature of the present embodiment effects initialization of the pressure roller of the tube pump. The step S12 discriminates whether the power supply was turned off in a sheet jammed state of manual sheet feeding.

If the power supply was turned off in such a jammed state, the pressure roller makes five idle turns in the forward direction (1080×5=5400 pulses) and then moves to a position A (tube pump initial operation ②). Otherwise, for example if the power supply was turned off in the stand-by state of the apparatus, the pressure roller rotates in the forward direction to the direction A, after the detection of the roller position by a sensor (tube pump initial operation ①).

Therefore, even when the power supply is turned off in a sheet jam during the manual sheet feeding after the ink moves toward the cap corresponding to 3500 pulses (a case of sheet jamming after full feeding of an A4-sized sheet), the above-mentioned forward rotation of 5400 pulses in the tube pump initial operation ② can move the ink in the tube toward the used ink receiving tank by 1900 (=5400−13500) pulses, thereby preventing reverse flow of the ink.

FIG. 6 is a schematic block diagram of the control unit of the present embodiment, including a CPU 201 for executing the sequence of the flow chart shown in FIG. 10, a ROM 202 storing fixed data including a program corresponding to said sequence, and a RAM 203 used as a work area. The RAM has a backup power source for maintaining the data even when the power supply of the main apparatus is cut off.

In the foregoing there has been explained the case of sheet jamming in the course of manual sheet feeding, but the initial operations also have to be conducted if the suction is interrupted by mechanical or other trouble or the power supply is turned off in the course of a recovery operation. The above-described suction operation is continued in the following manner. After the pressure roller 105 is stopped at the position Y, the aperture of the cap 102 is detached from the ink jet recording head 101 and left open. Thereafter the pressure roller 105 is rotated in the direction a, whereby the ink sucked into the tube moves toward the used ink receiving member 107.

However, if the power supply is turned off in the course of ink suction, for example while the pressure roller 105 is located between the positions X and Y, the ink remains in the tube. Also in this case, because of the function of the pressure roller as in the manual sheet feeding, the ink moves toward the cap 102 and may be spilled from the cap. For this reason, if the power supply is turned off in the course of a recovery operation, there are conducted additional idle rotations of the pressure roller in the initial operations at the next start of power supply.

[5th embodiment]

In the preceding embodiment, the amount of idle rotation at the start of power supply is kept constant (forward rotation corresponding to 5400 pulses), but this amount may be varied according to the amount of operation of the apparatus. For example, in case sheet jamming has occurred at 1000 pulses after the start of manual sheet feeding, the idle rotation is conducted for 2900 pulses at the next start of power supply. Since the ink is considered to have moved toward the cap over a distance corresponding to 1000 pulses, it is rendered possible to move the ink by 1900 pulses toward the used ink receiving member 107 as in the preceding embodiment. The duration of the initial operations at the start of power supply can be reduced by varying the amount of idle rotation depending on the state of jamming.

Similarly, the amount of idle rotation, in the initial operations at the start of power supply may be shortened depending on the condition of time. In the preceding embodiment, the amount of idle rotation is constant, regardless of the period from the turning-off of power supply in the sheet jam state during the manual sheet feeding to the next turning-on of power supply, regardless of whether the period is one minute or one year. If the apparatus is left unused for a long period, for example one year, after the sheet jamming, the ink may dry out, though such ink state may depend on the temperature and humidity in which the apparatus is left.

Thus, in case the apparatus is equipped with time measuring means, the additional idle rotations are not conducted in such case.

[6th embodiment]

In this embodiment, the sub scanning motor is used as a common driving source for the sheet feeding means and the tube pump. Also, a similar control for the initial operations is conceivable in case the main scanning motor is used as a common driving source for the carriage and the tube pump.

[7th embodiment]

In the following, the 7th embodiment of the present invention will be explained with reference to the attached drawings.

Figure 11A:
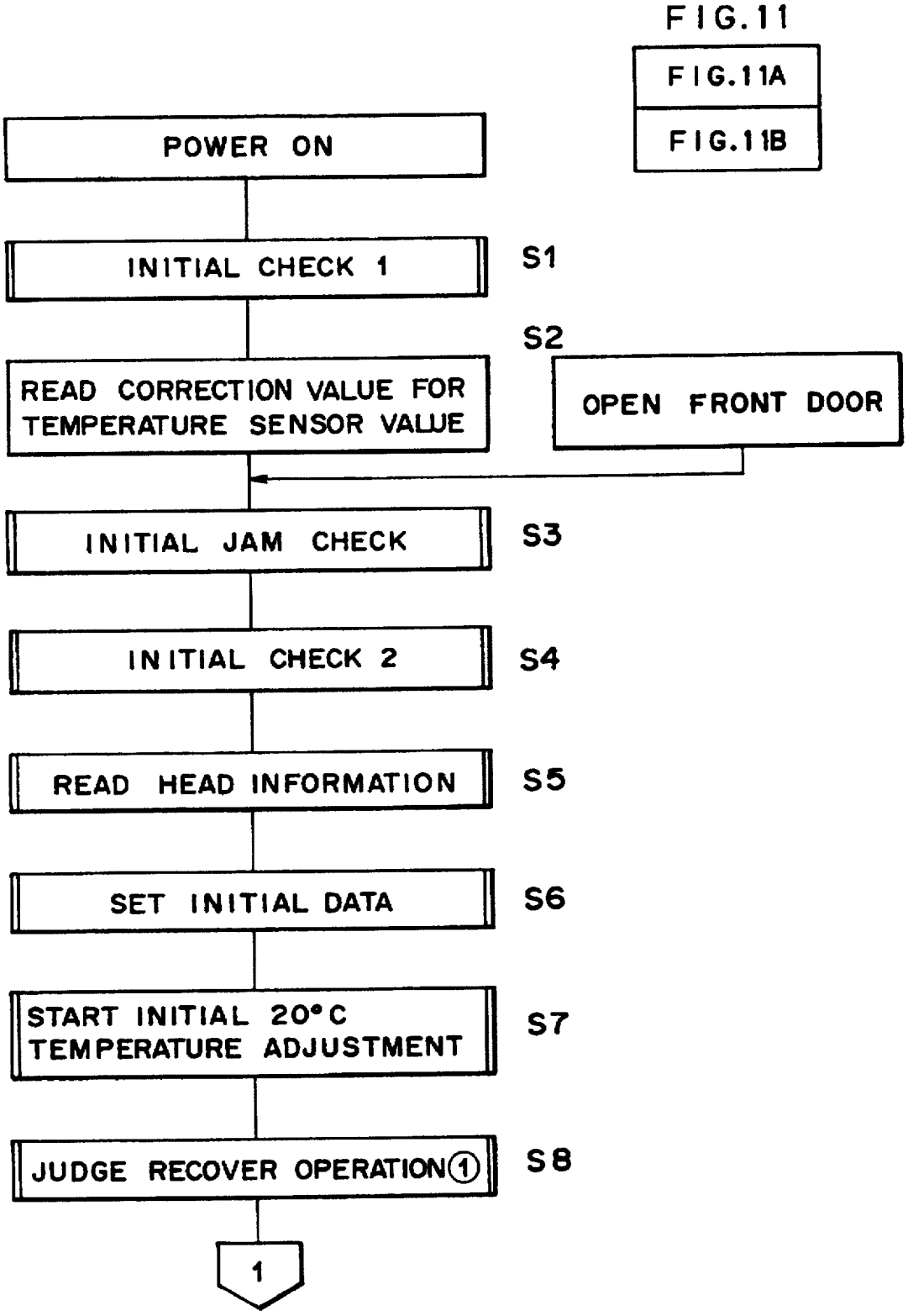
FIG. 11 shows the relationship between FIGS. 11A and 11B, which are a flow charts showings the main control sequence of still another embodiment of the ink jet recording apparatus of the present invention.
Figure 11B:
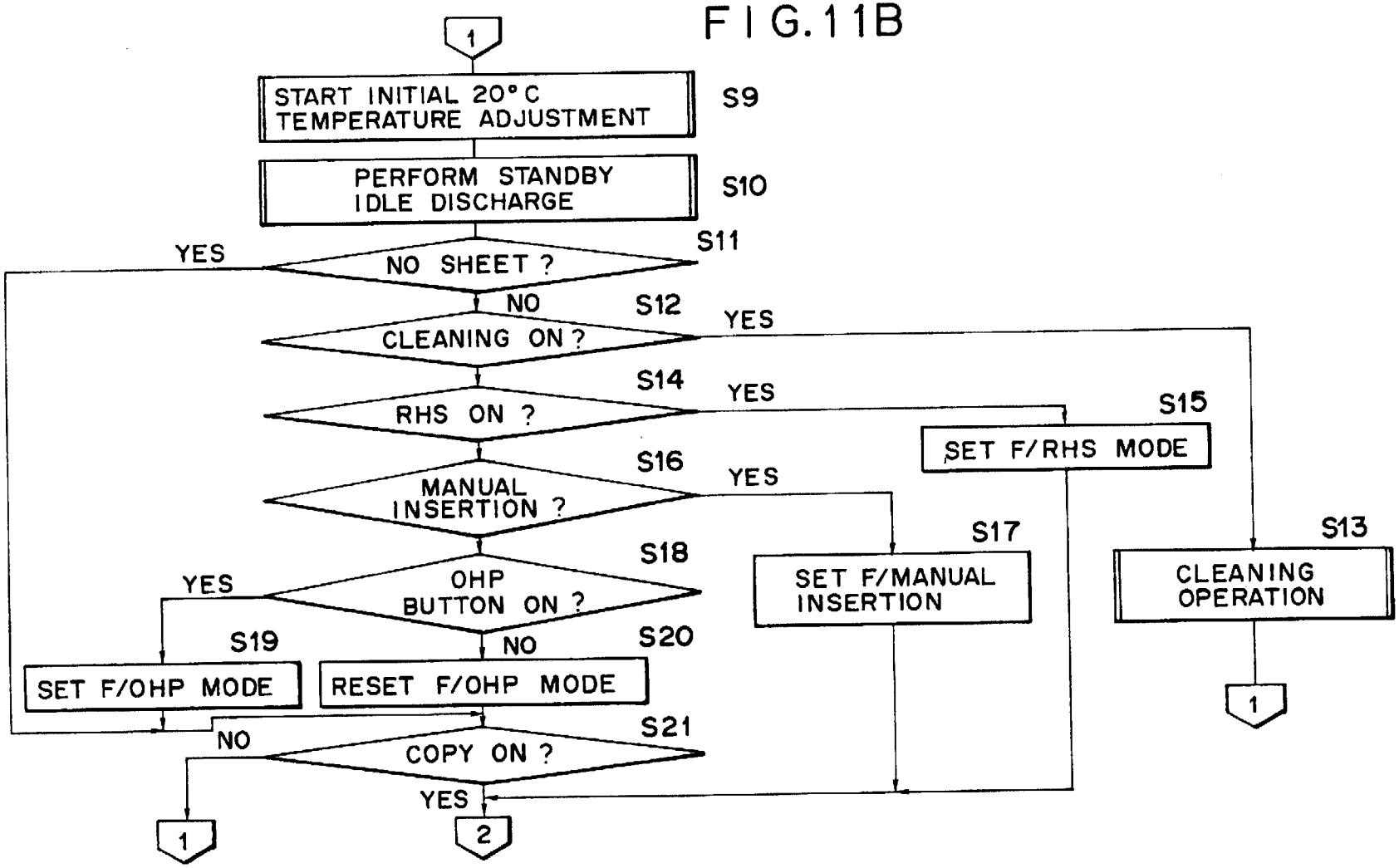
Figure 12:
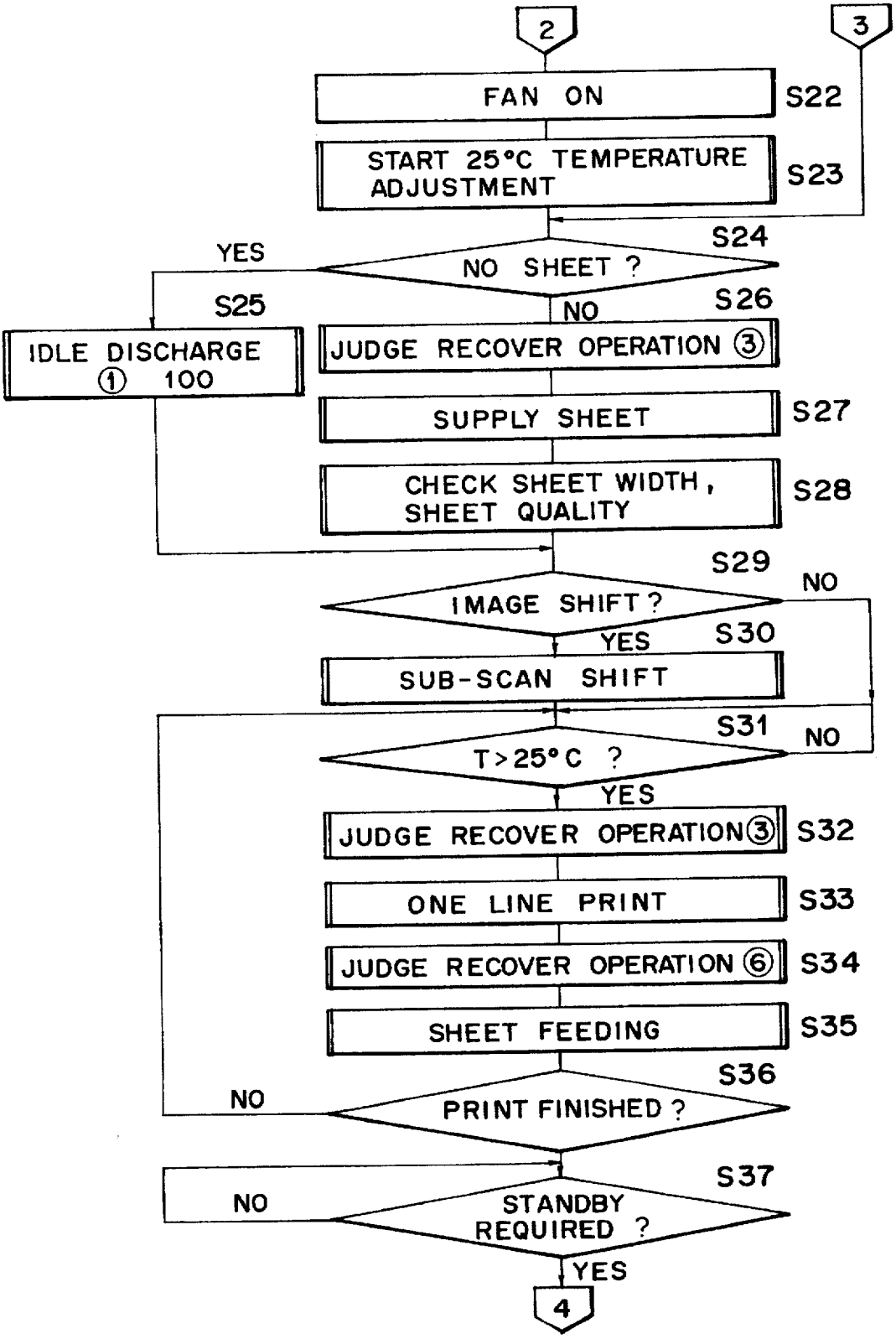
FIG. 12 is a flow chart of the main control sequence of still another embodiment of the ink jet recording apparatus of the present invention.
Figure 13:
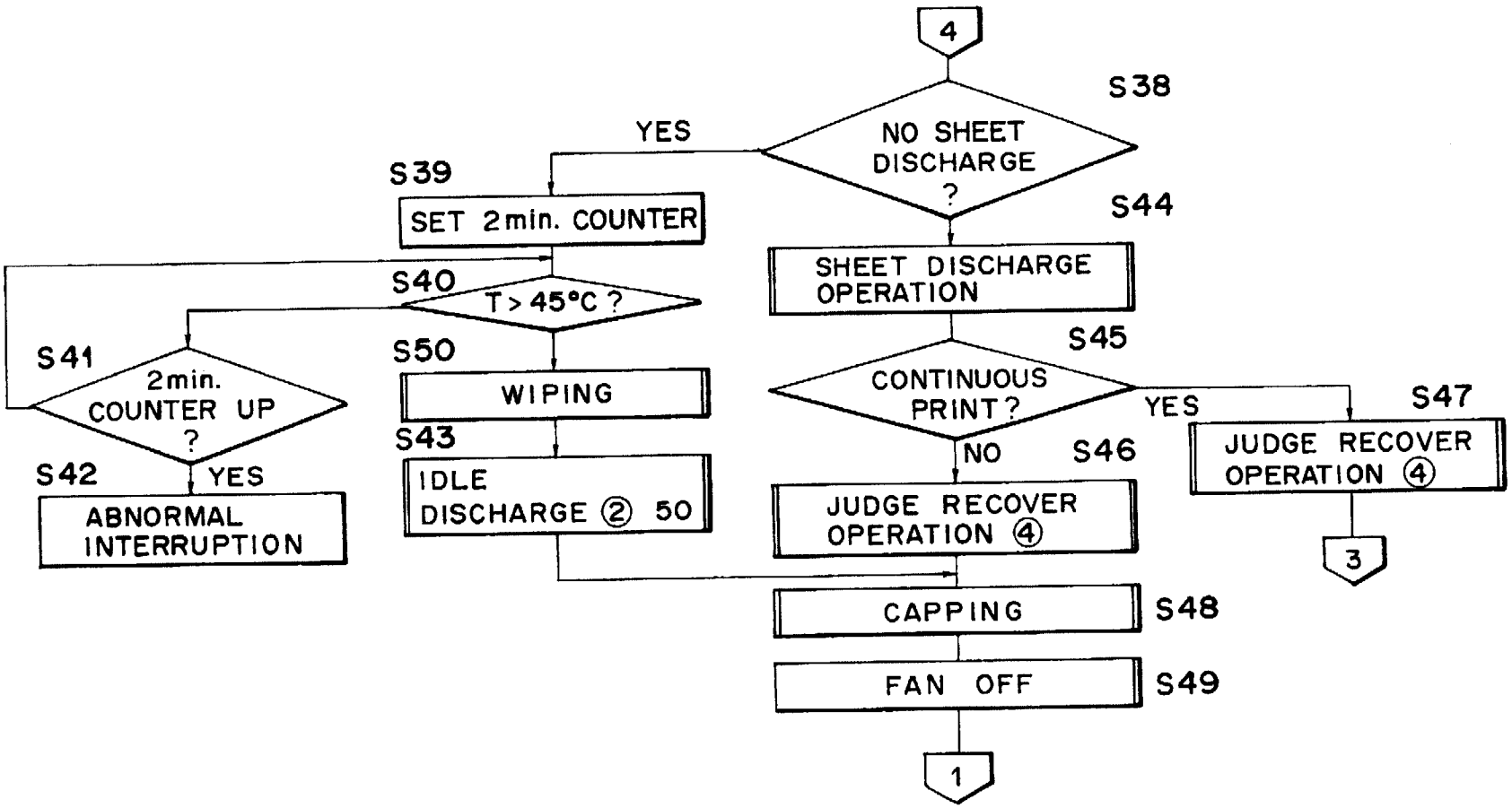
FIG. 13 is a flow chart of the main control sequence of still other embodiment of the ink jet recording apparatus of the present invention.

FIGS. 11 to 13 are flow charts showing the main control sequence of an ink jet recording apparatus constituting the 7th embodiment of the present invention.

When the power supply is turned on, step S1 effects initial check of the apparatus. This step confirms that the apparatus can function properly, by checking ROM and RAM, programs and data. A step S2 reads a correction value of a temperature sensor circuit, and a step S3 effects an initial jam check. In the present embodiment, the initial jam check is conducted in the step S3 also when the front door is closed. Then a step S5 checks the units of the apparatus required for reading the information of the recording head in the next step. A step S5 reads the ROM data incorporated in the recording head, and a step S6 sets the initial data.

Then a step S7 starts the initial temperature control for 20° C., and a step S8 effects recovery operation discrimination ① (whether or not to effect recovery operation by suction at the start of power supply). This completes the sequence flow to the waiting state.

The sequence in the stand-by state is conducted in the following manner. A step S9 effects temperature control at 20° C., and a step S10 effects stand-by idle ink discharge. Then a step S11 discriminates whether the recording sheet is fed, and, if not, the sequence proceeds to a step S12. A step S12 discriminates whether a cleaning button has been actuated, and, if actuated, a step S13 effects a cleaning operation. Then, if a step S14 identifies that an RHS button has been actuated, a step S15 sets an RHS mode flag. RHS stands for a recording head shading correction process, for correcting the density unevenness of the recording head. This process consists of reading the density unevenness of the printed pattern by an image reader and correcting any thus detected unevenness in density.

Then, if a step S16 identifies manual sheet feeding, a step S17 sets a manual feed flag, and the sequence proceeds to a step S22 for effecting a copy start sequence. Also if a step S18 identifies that an OHP button has been actuated, a step S19 sets an OHP mode flag. If the button has not been actuated, a step S20 resets the OHP mode flag. Then a step S21 discriminates whether a copy button has been actuated, and, if actuated, the sequence proceeds to step S22 for effecting the copy start sequence, but, if not actuated, the sequence returns to step S9. Also, when the cleaning operation in step S13 is completed, the sequence returns to step S9.

Figure 15:
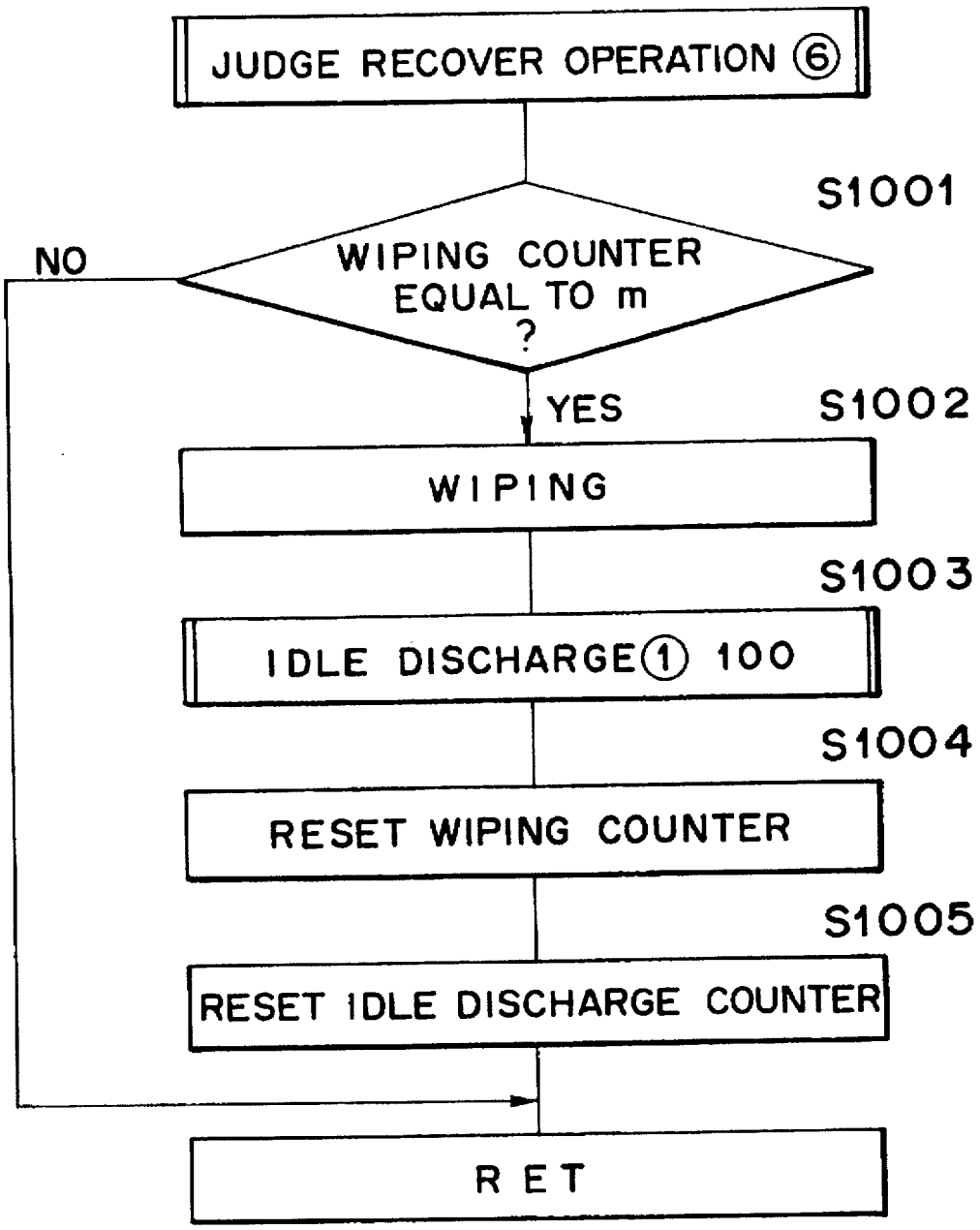
FIG. 15 is a flow chart of the recovery operation of still another embodiment of the ink jet recording apparatus of the present invention.

In the following, the copy sequence is now explained. A step S22 activates a fan for suppressing the temperature in the apparatus, and a step S23 starts the 25° C. temperature control. A step S24 discriminates whether the recording sheet has been fed, and, if not, a step S25 effects idle discharge ① (N=100; N indicating the number of idle discharges) and the sequence proceeds to step S29. Then step S26 effects recovery operation discrimination ③ (whether or not to effect recovery operation by suction prior to the sheet feeding), and a step S27 effects sheet feeding. A step S28 detects the width and kind of the sheet. A step S29 discriminates whether an image movement is to be conducted, and, if to be conducted, step S30 effects sheet movement in the sub scanning direction, but, if not to be conducted, the sequence proceeds to a step S31 for checking whether the recording head has reached 25° C. If 25° C. is reached, a step S32 effects recovery operation discrimination ③ (whether or not to effect recovery operation based on the amount of ink evaporation in the uncapped state), and a step S33 effects recording of a line. Then a step S34 effects recovery operation discrimination (whether or not to effect recovery operation, based on the timing of wiping; cf. FIG. 15), and a step S35 transports the recording sheet.

A step S36 discriminates whether the recording operation has been completed, and, if completed, the sequence proceeds to a step S37 after storage of data such as the number of printed pages in the ROM of the recording head. If the recording operation has not been completed, the sequence returns to the step S31. A step S37 discriminates whether the apparatus is to move into the stand-by state, and, if so, the sequence proceeds to a step S38.

Figure 16:
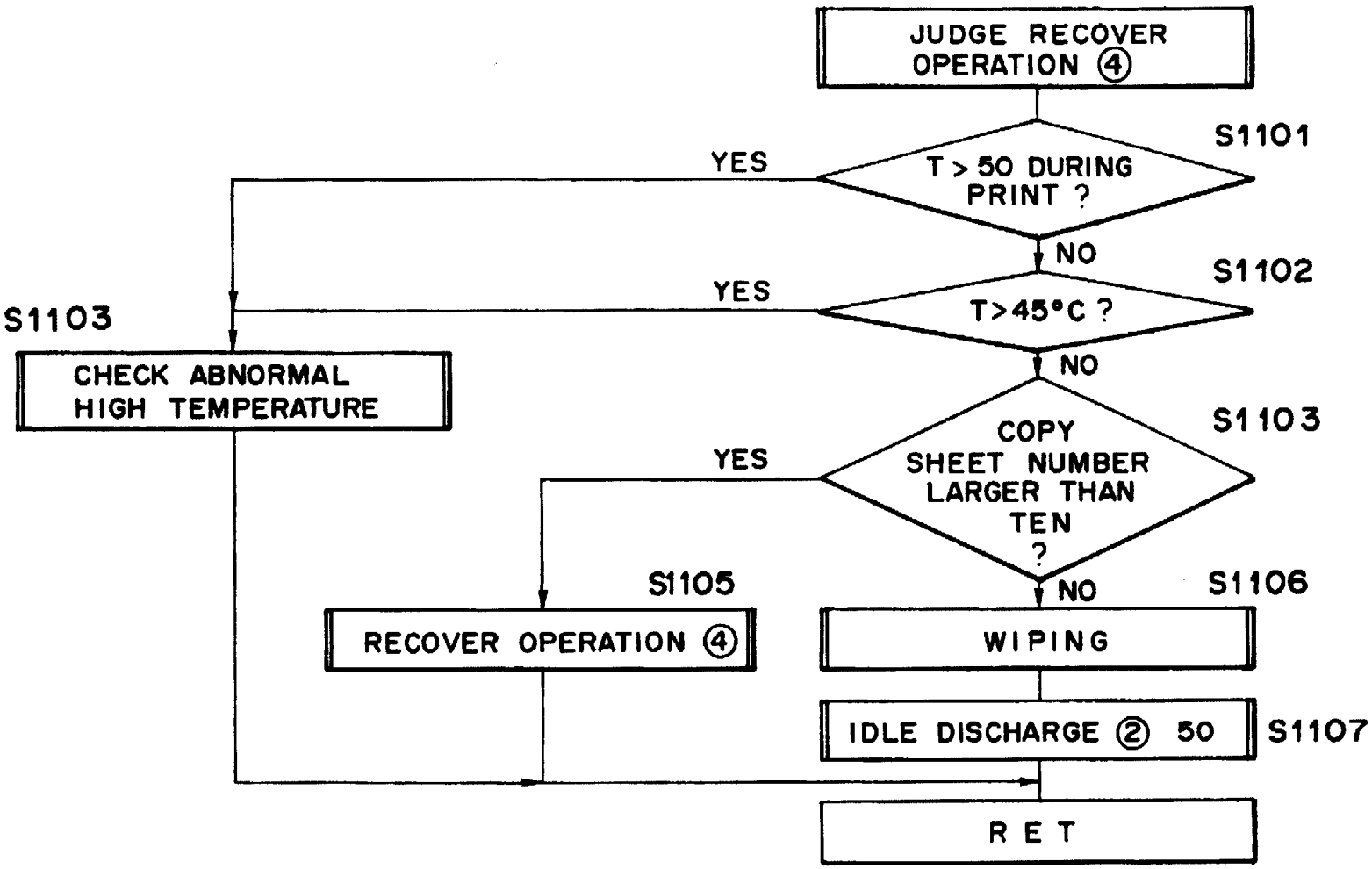
FIG. 16 is a flow chart of the recovery operation of still another embodiment of the ink jet recording apparatus of the present invention.

The step S38 starts a routine for effecting recovery operation discrimination ④ (recovery by removal of bubbles at printing, removal of bubbles in the liquid channel and cooling of abnormally high temperature) after sheet discharge and one-page printing. The step S38 discriminates whether a sheet discharge operation is conducted. If not, steps S39, S40 and S41 wait for the temperature to decrease to 45° C. or lower in 2 minutes, and, if the temperature does not come down within 2 minutes, a step S42 stops the function because of an abnormal situation. If the temperature comes down to 45° C. or lower, step S50 effects a wiping operation, then step S43 effects idle discharge ② (N=50), and step S48 effects a capping operation. On the other hand, if the sheet discharge operation is instructed, a step S44 effects the sheet discharge operation. Then a step S45 discriminates whether continuous recording is instructed, and, if instructed, after the recovery operation discrimination ④ (cf. FIG. 16), the sequence returns to the step S24. If not, a step S46 effects the recovery operation discrimination ④, and the step S48 effects the capping as in the absence of sheet discharge operation. Then a step S49 stops the fan, and the sequence returns to the step S9 thereby terminating the copying sequence.

Figure 14:
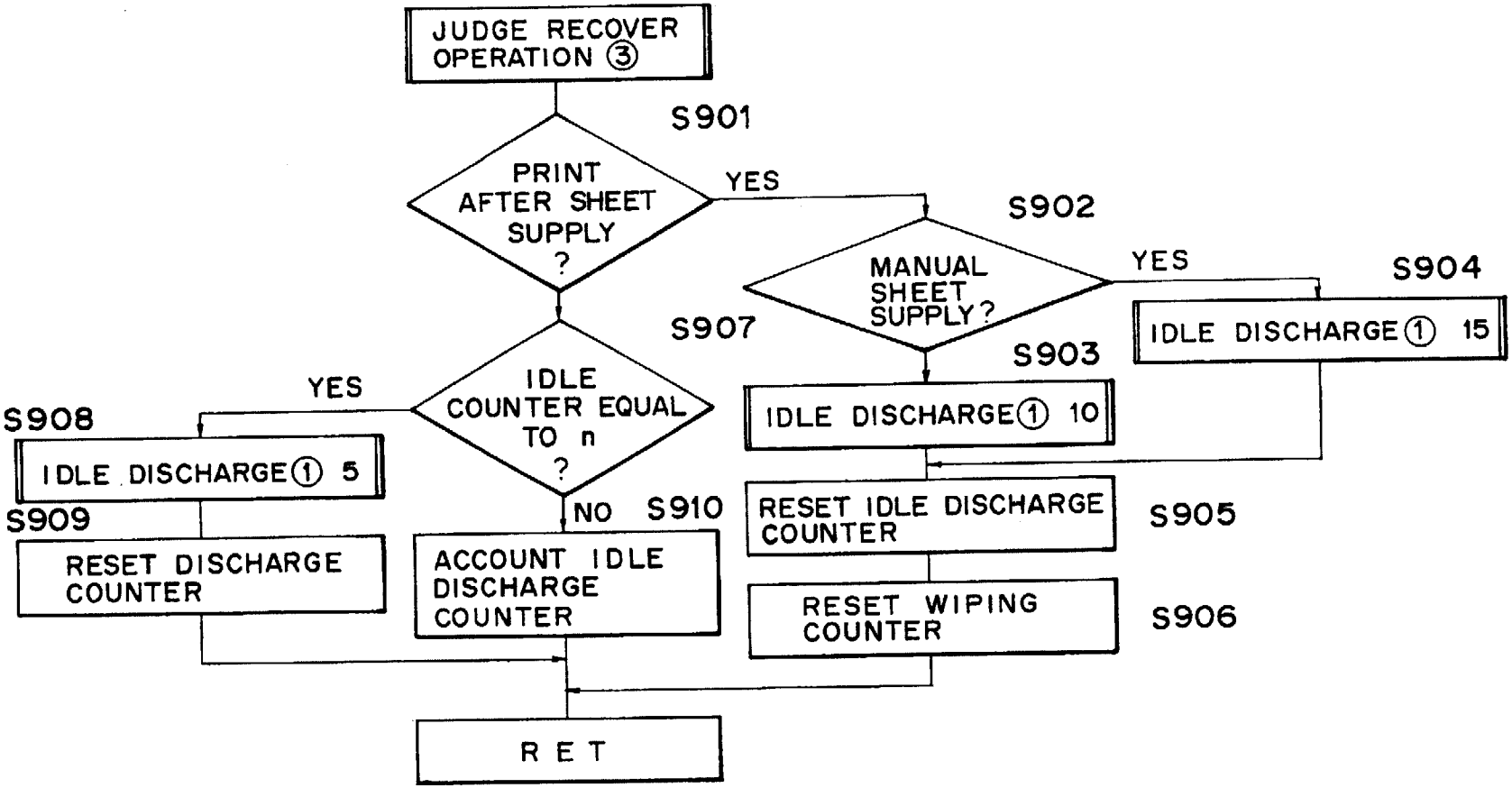
FIG. 14 is a flow chart showing the recovery operation in still another embodiment of the ink jet recording apparatus of the present invention.

FIG. 14 is a flow chart, representing the feature of the present embodiment, in which the recovery operation for the recording head is varied according to the sheet feeding method.

At first it is discriminated whether the sheet feeding operation has just been conducted, and, if not, the state of an idle discharge counter is checked. If the sheet feeding has just been conducted, it is discriminated whether the sheet has been fed manually or from the cassette, and the recovery operation is conducted. In the present embodiment, 15 or 10 idle discharges are conducted respectively in the manual sheet feeding or in the cassette sheet feeding. The reason for the larger number of idle discharges in the manual sheet feeding is based on "uncapped time" during which the head is not capped. The uncapped state is undesirable for the recording head, and a prolonged uncapped state necessitates a recovery operation. In the following there will be explained the function of the apparatus of the present embodiment, and the uncapped time thereof.

Figure 17:
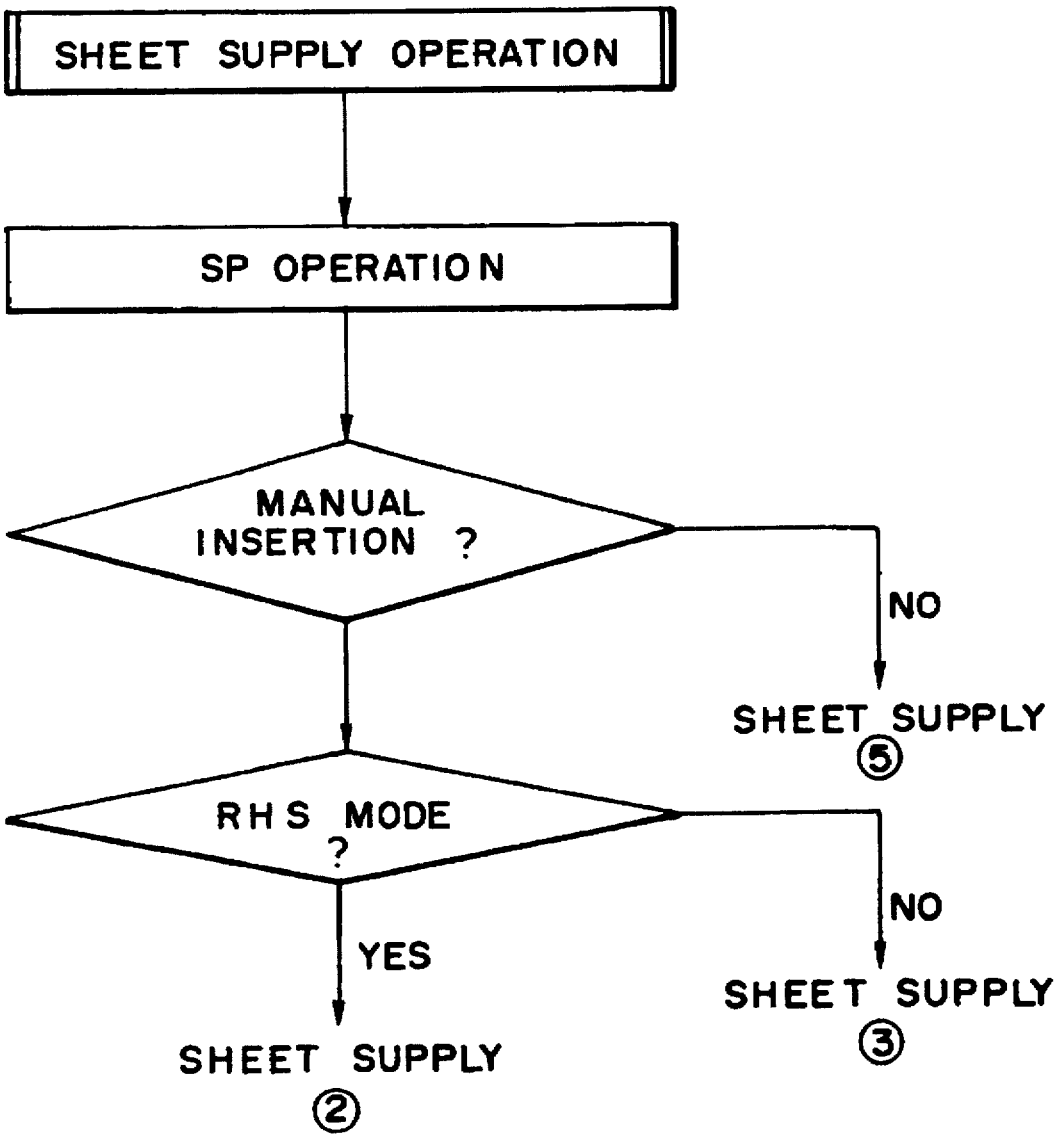
FIG. 17 is a flow chart showing the functions of still another embodiment of the ink jet recording apparatus of the present invention.

At the start of the sheet feeding operation, the carriage moves, as shown in FIG. 17, from a home position "HP" where the recording head is capped, to a start position. This movement is hereinafter called "SP movement". Upon movement to the start position, the recording head becomes detached from the cap. The capping in the home position and the uncapped state in the start position will be explained later.

After said SP movement, there is conducted a sheet feeding operation. In short, the manual sheet feeding requires a longer time than in the sheet feeding from the cassette, as will be explained in the following. The sheet feeding from the cassette is conducted as already explained in relation to FIG. 2. Also, the manual sheet feeding is conducted as already explained in relation to FIGS. 7 to 9.

Figure 18:
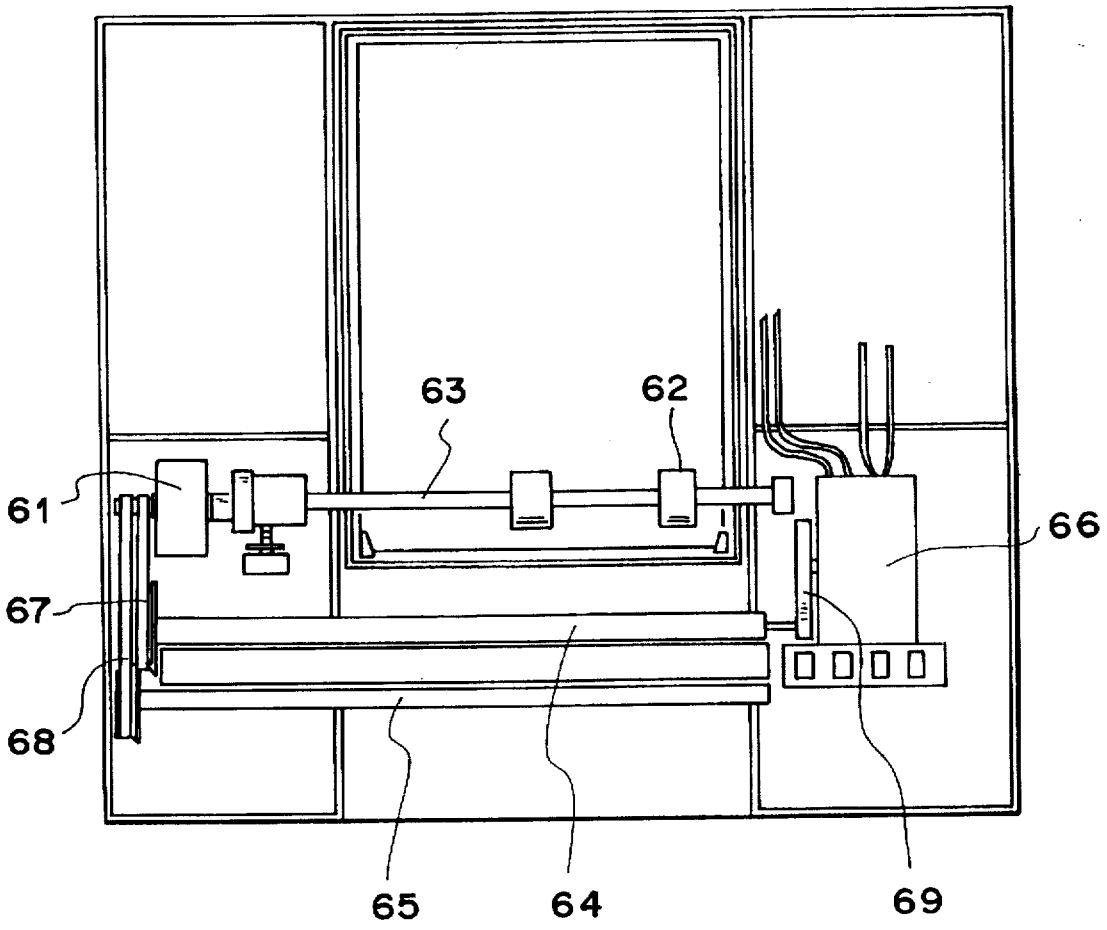
FIG. 18 is a schematic plan view of a principal part of still another embodiment of the ink jet recording apparatus of the present invention.

FIG. 18 is a schematic plan view showing driving systems for sheet transportation and for suction in the present embodiment. A subscanning motor 61 drives a sheet pickup roller 63, a sheet feed roller 64, sheet discharge rollers 65 and a suction pump 66. The pickup roller 63 rotates a semicircular roller 62, thereby picking up a sheet.

The driving force of the sub scanning motor is transmitted, respectively through driving belts 67, 68, 69, to the sheet feed roller 64, sheet discharge rollers 65 and suction pump 66.

In the present embodiment, the recovery operation after the sheet feeding is conducted only by idle discharge, without suction, because of the following reason.

Since a common driving system is used for the sheet transportation and for the suction, as shown in FIG. 18, sheet transporting rollers rotate when the suction pump is activated. Therefore, if a sheet is present in the sheet feeding rollers or in the sheet discharge rollers, the suction operation cannot be conducted as it will inevitably move the sheet.

[8th Embodiment]

At first there will be explained the capping in the home position and the uncapped state in the start position, employed in the present embodiment. Reference is made to FIGS. 19 and 20A to 20C, showing a structure adopting the above-mentioned conditions.

Figure 19:
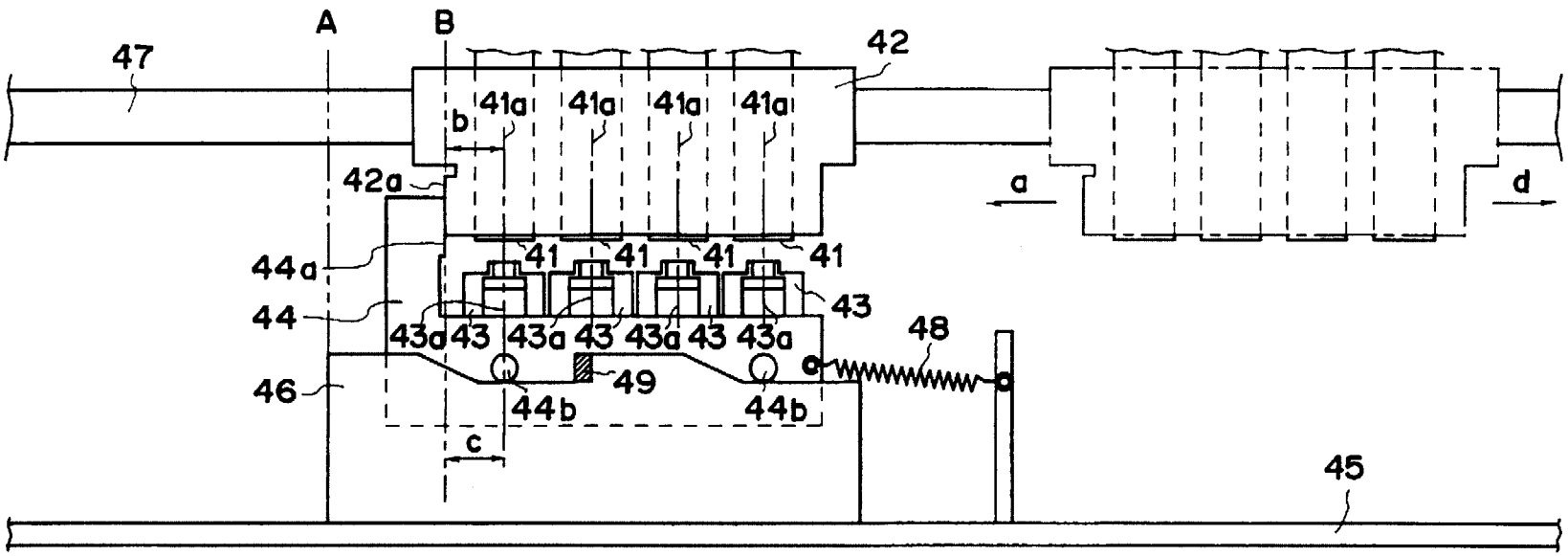
FIG. 19 is a schematic plan view of a capping mechanism of still another embodiment of the ink jet recording apparatus of the present invention.

Referring to FIG. 19, a main scanning carriage 42, supporting an ink jet recording head 41, is supported by a main scanning rail 47 and is movable in directions a and d for printing operation. Close to a bottom plate 45, there is provided a holder 44 having caps 43 which are composed of elastic material and serve to cover a front end portion of the ink jet recording head 41, in order to prevent clogging of the ink discharge openings thereof. The holder 44 is slidably placed, by means of positioning pins 44*b* thereof, on a guide member 46 fixed on the bottom plate 45, and is constantly biased in the direction d, by a spring 48.

A non-recording position A is called a home position of the carriage 42, at which are conducted the capping operation for preventing the clogging of the discharge openings of the recording head 41, and the recovery operations for the eventually closed openings, such as recovery by suction, recovery by pressurizing, and/or recovery by ink circulation within the recording head. A position B is called start position, from which the carriage 42 initiates the recording operation. The home position A and start position B are defined with respect to a positioning part 42*a* of the carriage 42.

Figure 20A:
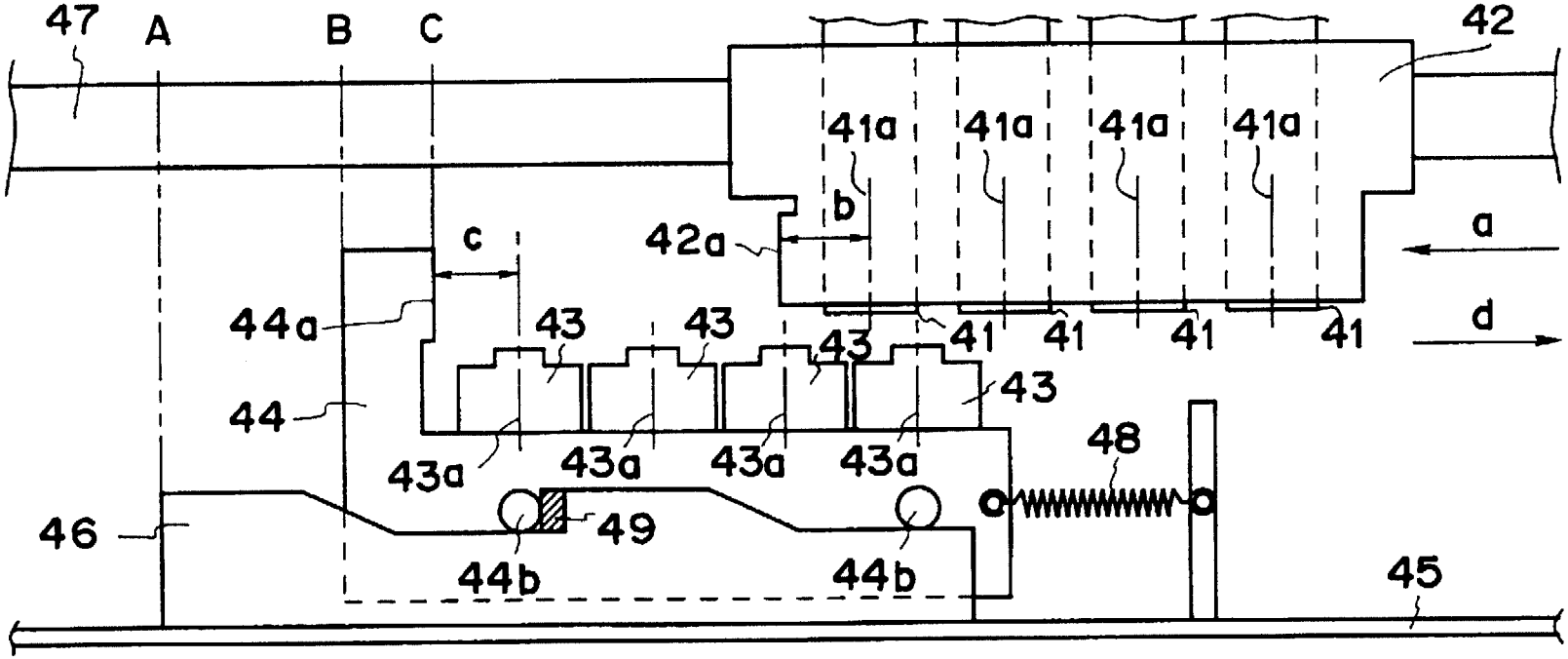
FIGS. 20A to 20C are schematic plan views showing capping operations in still another embodiment of the ink jet recording apparatus of the present invention.
Figure 20B:
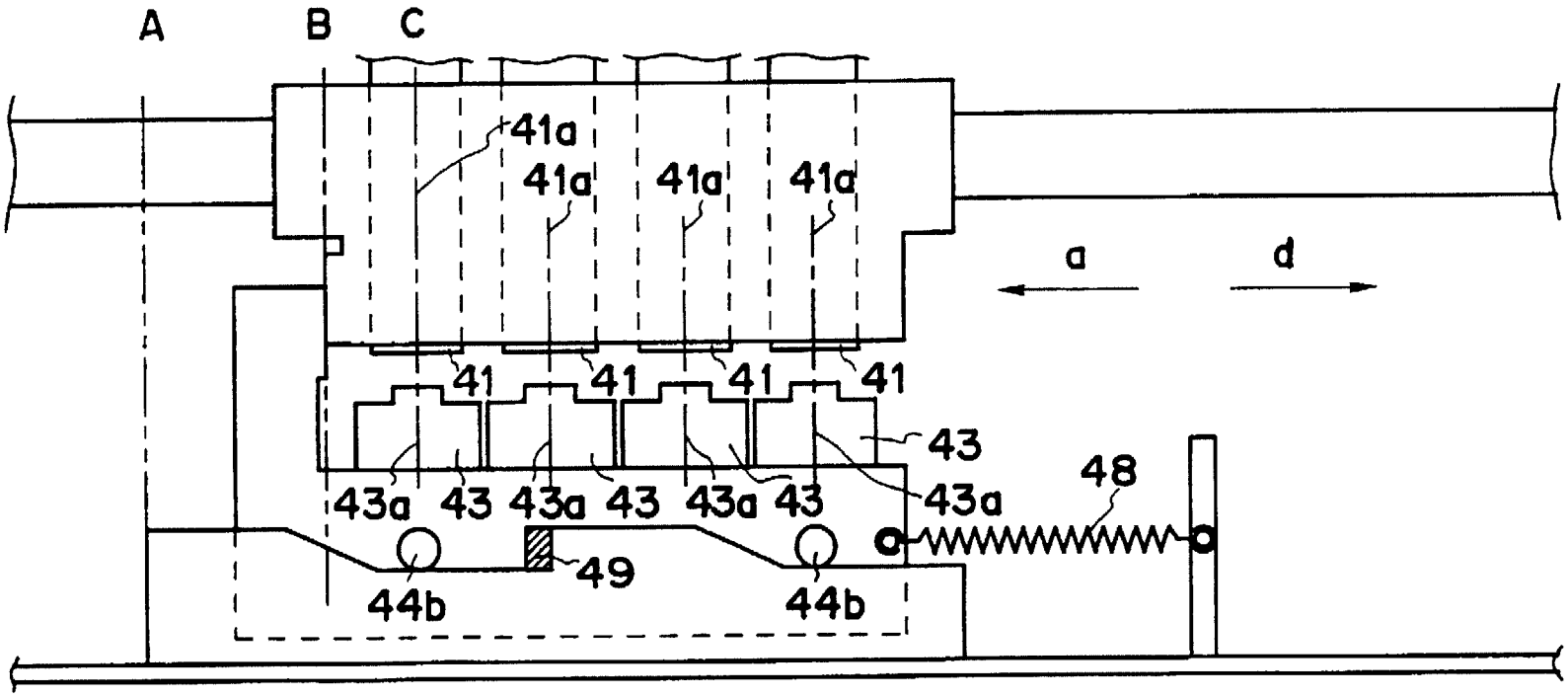
Figure 20C:
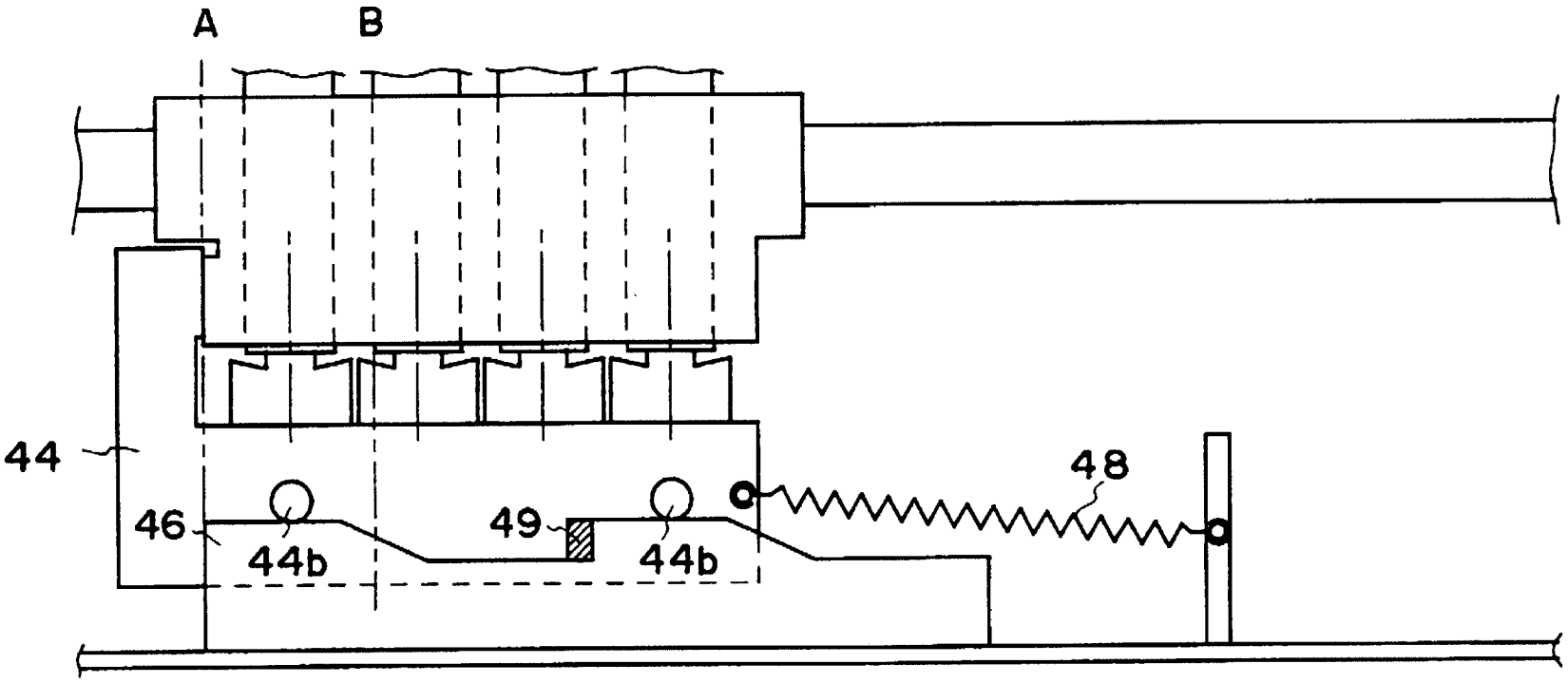

Now reference is made to FIGS. 20A to 20C for explaining the function of the above-explained structure. It is to be noted that the spring 48 in FIG. 19 is positioned in slanted manner while that in FIGS. 20A to 20C is parallel to the desired biasing direction. After a recording operation in a scanning motion, the carriage 42 moves in the direction a toward the start position B, and the positioning part 42*a* of the carriage 42 comes into contact with a positioning part 44*a* of the holder 44 at a position C (stand-by position of the carriage 42) as shown in FIG. 20A in front of the start position B. As the carriage 42 moves further in the direction a, the holder 44 moves together and the carriage 42 arrives at the position B (FIG. 20B). At this position the carriage 42 is reversed and starts to move in the direction a for the next recording operation. The spring 48, provided for biasing the holder 44 toward the printing side for positioning the carriage 42 and the holder 44, also serves as a damper for suppressing the vibration of the carriage 42 in stopping at the start position.

At said start position, since said ink jet recording head and the carriage are in a mutually separated and opposed relationship, the cap can collect the ink scattered at the reversing of the carriage, particularly that caused by inertia at the high-speed reversing thereof. In the present embodiment, the ability to collect of scattered ink is improved since the cap is positioned close to the recording head.

When the carriage 42 moves in the direction d from the start position B for the next recording operation, the holder 44 also moves in direction d, together with the carriage 42, by means of the force of the spring 48. Subsequently, the positioning pin 44*b* of the holder 44 comes into contact with an elastic member 49 provided in a stopper portion of the guide member 46, whereby the holder 44 is stopped and separated from the carriage 42. In this state, the elastic member 49 serves to prevent the generation of noise, which is ordinarily generated by the contact of the positioning pin 44*d* and the stopper portion of the guide member 46. The elastic member may be composed of rubber or a compression coil spring.

Also, in case of effecting idle discharge of ink droplets from all the discharge openings for the purpose of stabilizing the state thereof in the recording operation, such idle discharge may be conducted between the position C and the start position B shown in FIG. 20B, whereby the droplets generated in such idle discharge from the ink jet recording head can be emitted into the cap 43. If the distance b from the positioning part 42*a* of the carriage 42 to the center of 41*a* of the discharge opening of the recording head 41 is selected to be equal to the distance c from the positioning member 44*a* of the holder 44 to the center 43*a* of the cap 43 for each set of head and cap, the ink jet recording head 41 and the cap 43 are aligned in the main scanning direction when the positioning part 42*a* of the carriage 42 comes into contact with the positioning part 44*a* of the holder 44.

During the non-recording state, the carriage 42 moves further in the direction a beyond the start position B as shown in FIG. 20C, whereby the positioning pins 44*b* provided on the holder 44 move along inclined faces of the holder 46, and the holder also moves toward the carriage 42 while moving in the direction a. Thus, eventually at the home position A, the cap 43 contacts the ink jet recording head 41, thus completing the capping operation. In the home position, there is conducted the operation of generating negative pressure in the cap 43, thus sucking ink from eventually clogged discharge openings of the ink jet recording head and restoring the original state, by means of a suction pump, tube etc. (not shown)

In the present embodiment, the duration of uncapped state varies according to the sheet size, in case switch-back manual sheet feeding. More specifically, the time is somewhat longer for the A4 size than for the B5 size.

Also in certain recording modes, the interval between the recording of lines becomes longer. For example, in case of an image recording by connection with an external equipment, the interval between the recordings of lines becomes longer by 2 to 3 seconds, so that the carriage stays at the start position accordingly longer. This means that the uncapped time becomes longer. In order to respond to the variation in uncapped time during the recording operation depending on the recording mode, the recovery operation discrimination ③ is replaced by the recovery operation discrimination ③' thereby controlling the number of idle discharges after the manual sheet feeding and those after every n lines, according to the uncapped time.

Figure 21A:
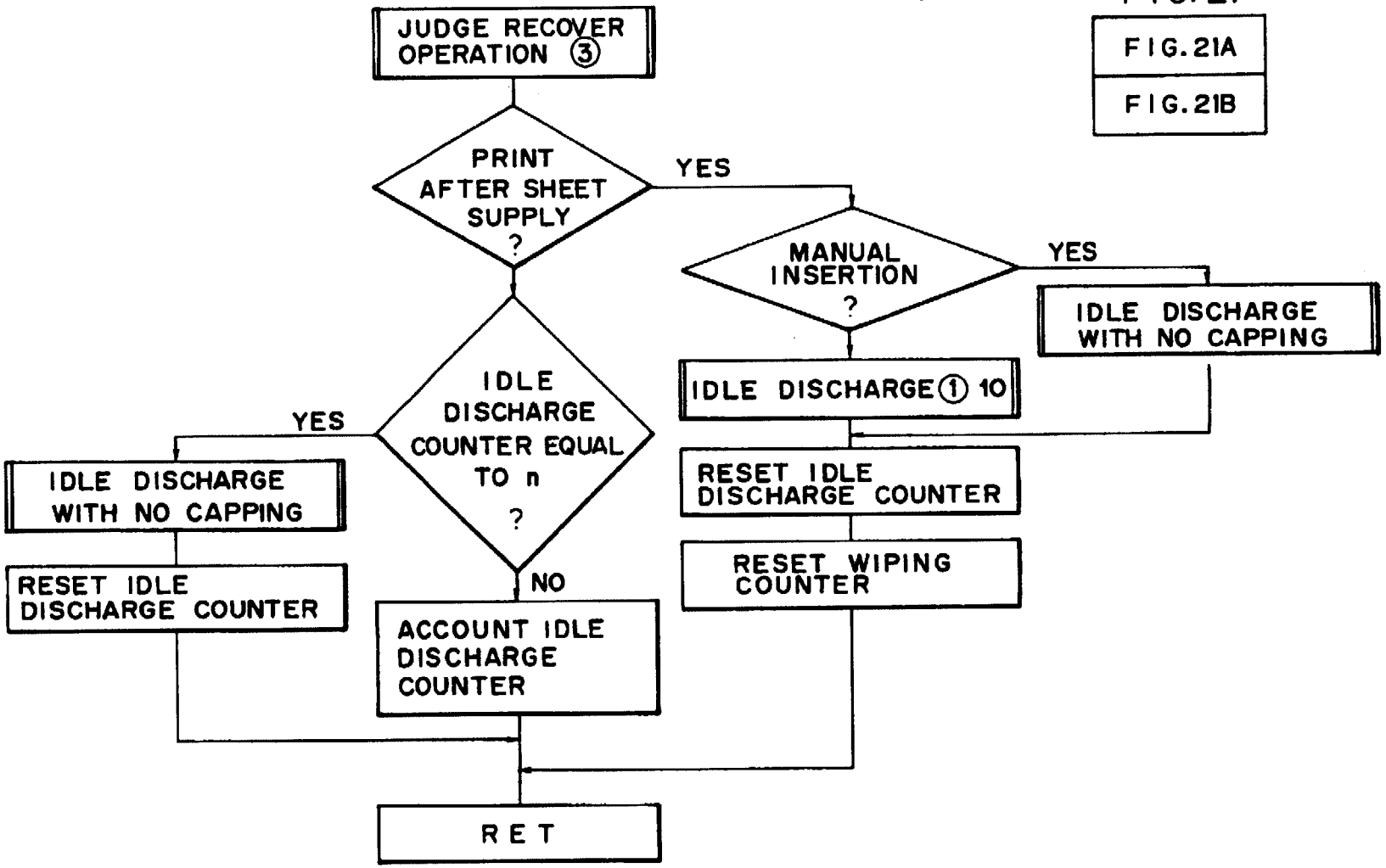
FIG. 21 is a chart showing the relationship between FIGS. 21A and 21B which are flow charts showings the recovery operation in still another embodiment of the ink jet recording apparatus of the present invention.
Figure 21B:
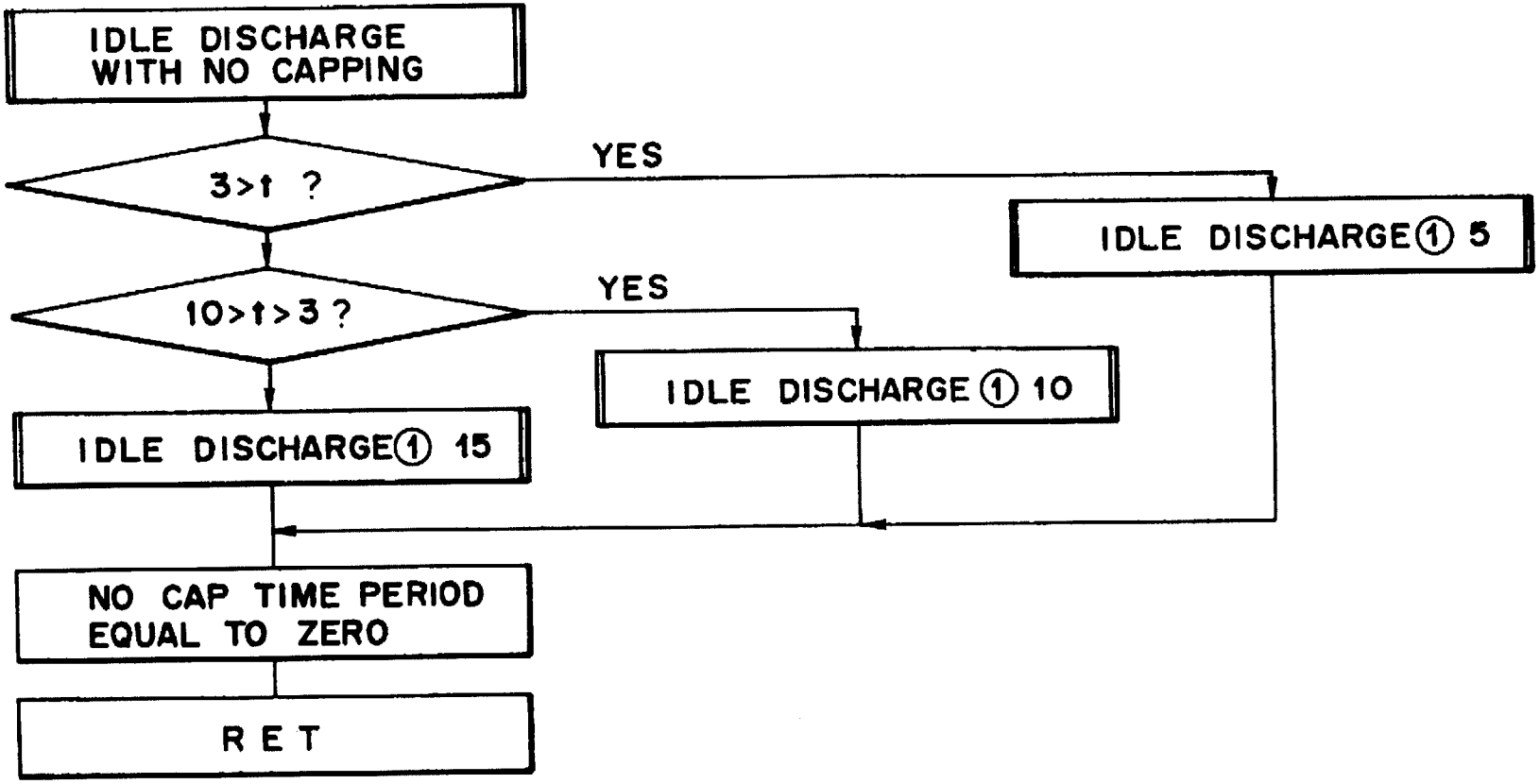

FIG. 21 is a flow chart showing the recovery operation discrimination ③'. When the recording head is uncapped at the sheet feeding, a timer for measuring the uncapped time t is reset to zero. At the manual sheet feeding and at every n lines, there are conducted 5 idle discharges if t is less than 3 seconds, 10 idle discharges if t is 3 to 10 seconds, and 15 idle discharges if t is longer than 10 seconds. For reference, the ordinary sheet feeding from the cassette requires about 7 seconds, manual feeding of an A4-sized sheet requires about 10 seconds, and recording of a line requires about 2 seconds.

As explained in the 7th and 8th embodiments, when the same motor is used for driving the suction pump and for sheet feeding, a compensation is achieved for example by increasing the number of idle ink discharges in the case of manual sheet feeding, since the uncapped time is longer in the switch-back manual sheet feeding than in the cassette sheet feeding. Such operation of varying the recovery condition according to the sheet feeding condition minimizes the amount of ink discharged for recovery, and help to obtain uniform and improved image quality.

Among various ink jet recording methods, the present invention brings about a particularly excellent effect when applied to a recording head of a system provided with means for generating thermal energy for ink discharge and causing a state change in the ink by that thermal energy, and a recording apparatus employing such a recording head, since such a system achieves a higher density and a higher definition of the recording.

The principle and representative configuration of the system are disclosed, for example, in U.S. Pat. Nos. 4,723,129 and 4,740,796. This system is applicable to the so-called on-demand recording or continuous recording, but is particularly effective in the on-demand recording because, in response to the application of at least a drive signal representing the recording information to an electrothermal converter element positioned corresponding to a liquid channel or a sheet containing liquid (ink) therein, the element generates thermal energy capable of causing a rapid temperature increase exceeding the nucleus boiling point, thereby inducing film boiling on a heat action surface of the recording head and thus forming a bubble in the liquid (ink), in one-to-one correspondence with the drive signal. That liquid (ink) is discharged through a discharge opening by the growth and contraction of the bubble, thereby forming at least a liquid droplet. That drive signal is preferably formed as a pulse, as it realizes instantaneous growth and contraction of the bubble, thereby attaining highly responsive discharge of the liquid (ink). Such a pulse-shaped drive signal is preferably like that disclosed in the U.S. Pat. Nos. 44,463,359 and 4,345,262. Also, the conditions described in the U.S. Pat. No. 4,313,124 relative to the temperature increase rate of the heat action surface helps to obtain further improved recording.

The configuration of the recording head is given by the combinations of the liquid discharge openings, liquid channels and electrothermal converter elements with linear or rectangular liquid channels, disclosed in the above-mentioned patents, while the configuration disclosed in U.S. Pat. No. 4,558,333 in which the heat action part is positioned in a flexed area, and a configuration disclosed in the U.S. Pat. No. 4,459,600 also relate to the present invention. Furthermore, the present invention is effective in the structure disclosed in the Japanese Patent Laid-Open No. 59-123670, having a slit common to plural electrothermal converter elements as a discharge opening therefor, or in the structure disclosed in the Japanese Patent Laid-Open No. 59-138461, having an aperture for absorbing the pressure wave of thermal energy, in correspondence with each discharge opening.

A full-line type recording head, capable of simultaneous recording over the entire width of the recording sheet, may be obtained by plural recording heads combined so to provide the required length as disclosed in the above-mentioned patents, or may be constructed as a single integrated recording head, and the present invention can more effectively exhibit its advantages in such a recording head.

The present invention is furthermore effective in a recording head of the interchangeable chip type, which can receive ink supplied from the main apparatus and can be electrically connected therewith upon mounting on the main apparatus, or a recording head of cartridge type in which an ink cartridge is integrally constructed with the recording head.

Also, the recording apparatus is preferably provided with the emission recovery means and other auxiliary means for the recording head, since the effects of the recording head of the present invention can be stabilized further. Examples of such means include capping means, cleaning means, pressurizing or suction means, preliminary heating means composed of electrothermal converter element and/or another heating device, and means for effecting an idle ink discharge independent from the recording operation, all of which are effective for achieving stable recording operation.

Furthermore, the present invention is not limited to a recording mode for recording a single main color such as black, but is extremely effective also to the recording head for recording plural different colors or full color by color mixing, wherein the recording head is either integrally constructed or is composed of plural units.

Although liquid ink is employed in the foregoing embodiments, the present invention is applicable also to ink which is solid below room temperature but which softens at room temperature. As the above-explained ink jet recording apparatus generally controls the ink temperature within a temperature range of 30° to 70° C. thereby maintaining the viscosity of ink within a stably dischargeable state, the ink only needs to be liquefied when the recording signal is given. Besides the recording head of the present invention can employ ink liquefied by thermal energy provided corresponding to the recording signal, such as the ink in which the temperature increase by thermal energy is intentionally absorbed by the state change from solid to liquid, or the ink which remains solid in the unused state for the purpose of prevention of ink evaporation, or the ink which starts to solidify upon reaching the recording sheet. In these cases the ink may be supported as solid or liquid in recesses or holes of a porous sheet, as described in Japanese Patent Laid-Open Nos. 54-56847 and 60-71260, and placed in an opposed state to the electrothermal converter element. The present invention is most effective when the above-mentioned film boiling is induced in the ink of the abovementioned forms.

Since tube pump means, realizing suction or pressurization by deformation of a tube, applicable to an ink jet recording apparatus and sheet transport means have a common driving source, the functions of these means are rendered constant and mutually correlated, so that the initial operations of those means at the start of power supply can be executed by means of a single sensor. This enables miniaturization of the ink jet recording apparatus. Also, the use of a common driving source reduces the number of component parts, thereby reducing cost.

Also, the ink jet recording apparatus comprises at least two sheet feeding means such as those for sheet feeding from a cassette and for manual sheet feeding, tube pump means for realizing suction or pressurization utilizing deformation of a tube, applicable to an ink jet recording apparatus, a driving source for driving the sheet feeding means and said tube pump means control means for effecting initial operations of said tube pump at the start of power supply memory means for memorizing the state of the apparatus at the turning-off of power supply and control means for effecting the operations at the start of power supply based on the information on the state of the apparatus at the turning-off of power supply. The control means checks the state of the apparatus at the turning-off of power supply when the power supply is again turned on, and, if the power supply is turned off in a sheet jammed state in a manual sheet feeding operation, there are conducted initial operations and an operation for preventing reverse ink flow in the recovery unit, but, if such a sheet jammed state does not exist, there are conducted initial operations only.

The above-mentioned control prevents overflow of ink in the tube pump from cap, that can occur for example in case of consecutive sheet jams in the manual sheet feeding.

What is claimed is:

1. An ink jet recording apparatus for effecting recording by ink discharge from an ink jet recording head onto a recording material, comprising:

recovery means for maintaining and restoring an ink discharge state of said ink jet recording head;

recording material transport means for transporting the recording material from a feeding position through a recording position to a discharge position;

common driving means for driving said recovery means and said transport means;

memory means for memorizing at least a one of a state of said recovery means and a state of said transport means immediately before a power supply of said recording apparatus is turned off; and control means for effecting an initialization of said recovery means corresponding to the state memorized in said memory means.

2. An ink jet recording apparatus according to claim 1, further comprising:

support means for supporting said ink jet recording head;

sensor means for detecting operation starting conditions of said recording material transport means and said recovery means by detecting a state regarding the common driving means; and wherein said common driving means additionally drives said support member.

3. An apparatus according to claim 2, wherein said ink jet recording head comprises means for generating thermal energy for causing film boiling of said ink, as energy to be utilized for ink discharge.

4. An apparatus according to claim 2, wherein said recovery means comprises a cap member for covering a face of discharge opening of the recording head, and a tube pump connected to said cap member and serving to collect the ink discharged from said recording head.

5. An apparatus according to claim 1, wherein said ink jet recording head comprises means for generating thermal energy for causing film boiling of said ink, as energy to be utilized for ink discharge.

6. An apparatus according to claim 1, wherein said recovery means comprises a cap member for covering a face of discharge opening of the recording head, and a tube pump connected to said cap member and serving to collect the ink discharged from said recording head.

7. An ink jet recording apparatus for effecting recording by ink discharge from an ink jet recording head onto a recording material, comprising:

recovery means for maintaining and restoring an ink discharge state of said ink jet recording head;

carriage means supporting said ink jet recording head and capable of relative movement to the recording material, thereby enabling desired recording;

common drive means for driving said recovery and said carriage means;

memory means for memorizing at least a one of a state of said recovery means and a state of said carriage means immediately before a power supply to the recording apparatus is turned off; and control means for effecting initialization of said recovery means corresponding to the state memorized in said memory means.

8. An apparatus according to claim 7, wherein said ink jet recording head comprises means for generating thermal energy for causing film boiling of said ink, as energy to be utilized for ink discharge.

9. An apparatus according to claim 7, wherein said recovery means comprises a cap member for covering a face of discharge opening of the recording head, and a tube pump connected to said cap member and serving to collect the ink discharged from said recording head.

10. An ink jet recording apparatus for effecting recording by ink discharge from an ink jet recording head onto a recording sheet, comprising:

recovery means for maintaining and restoring an ink discharge state of said ink jet recording head;

recording sheet feeding means for feeding the recording sheet to a recording position for recording by said ink jet recording head; and control means for varying a recovery condition provided by said recovery means according to a recording sheet feeding condition of said recording sheet feeding means, wherein said control means varies the recovery condition according to a sheet supplying mode selected from a manual mode, in which a recording sheet is supplied manually, and an automatic mode, in which a recording sheet is supplied from a cassette.

11. An apparatus according to claim 10, further comprising support means for supporting said ink jet recording head.

12. An apparatus according to claim 10, wherein said ink jet recording head comprises means for generating thermal energy for causing film boiling of said ink, as energy to be utilized for ink discharge.

13. An apparatus according to claim 10, wherein said recovery means comprises a cap member for covering a face of a discharge opening of said ink jet recording head, and a tube pump connected to said cap member and serving to collect the ink discharged from said recording head.

14. An apparatus according to claim 10, wherein said recovery condition is varied by changing a number of idle discharges of ink from said ink jet recording head.

* * * * *

UNITED STATES PATENT AND TRADEMARK OFFICE

CERTIFICATE OF CORRECTION

PATENT NO. : 5,717,443

DATED : February 10, 1998

INVENTOR(S) : YASUHIRO NUMATA, ET AL.

It is certified that error appears in the above-identified patent and that said Letters Patent is hereby corrected as shown below:

TITLE PAGE:

AT [30] FOREIGN APPLICATION PRIORITY DATA

"Jan. 8, 1991" should read --Jan. 18, 1991--.

AT [56] REFERENCES CITED

FOREIGN PATENT DOCUMENTS

"62-122572 5/1988 Japan" should read
--63-122572 5/1988 Japan--;
"1082962 3/1989 Japan" should read
--1-82962 3/1989 Japan--; and
Insert: --62-235361 5/1987 Japan--.

COLUMN 1

Line 36, "positining)" should read --positioning)--; and
Line 49, "the, inventors" should read
--object, the inventors--.

COLUMN 3

Line 4, "a" should be deleted and "showings" should read
--showing--; and
Line 36, "showings" should read --showing--.

COLUMN 4

Line 32, "said" should be deleted; and
Line 42, "rotated in a" should be deleted.

UNITED STATES PATENT AND TRADEMARK OFFICE

CERTIFICATE OF CORRECTION

PATENT NO. : 5,717,443

DATED : February 10, 1998

INVENTOR(S) : YASUHIRO NUMATA, ET AL.

It is certified that error appears in the above-identified patent and that said Letters Patent is hereby corrected as shown below:

COLUMN 5

Line 42, "forms" should read --form--.

COLUMN 6

Line 61, "101A." should read --(not shown).--; and
Line 63, "constitutes" should read --leads to--.

COLUMN 7

Line 36, "anticlockwise" should read --counterclockwise--; and
Line 50, "anticlockwise" should read --counterclockwise--.

COLUMN 8

Line 11, "(=5400-13500)" should read --(=5400-3500)--.

COLUMN 10

Line 4, "if" should read --if it is--.

COLUMN 13

Line 30, "help" should read --helps--.

COLUMN 15

Line 65, "discharge" should read --a discharge--.

UNITED STATES PATENT AND TRADEMARK OFFICE

CERTIFICATE OF CORRECTION

PATENT NO. : 5,717,443

DATED : February 10, 1998

INVENTOR(S) : YASUHIRO NUMATA, ET AL.

It is certified that error appears in the above-identified patent and that said Letters Patent is hereby corrected as shown below:

COLUMN 16

Line 6, "discharge" should read --a discharge--;
Line 17, "recovery" should read --recovery means--; and
Line 32, "discharge" should read --a discharge--.

Signed and Sealed this

Twenty-seventh Day of October, 1998

*Attest:*

*Attesting Officer*

BRUCE LEHMAN

*Commissioner of Patents and Trademarks*